US006831672B2

(12) United States Patent
Maeda

(10) Patent No.: US 6,831,672 B2
(45) Date of Patent: Dec. 14, 2004

(54) IMAGE FORMING APPARATUS

(75) Inventor: Katsuhiko Maeda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/618,733

(22) Filed: Jul. 15, 2003

(65) Prior Publication Data

US 2004/0070661 A1 Apr. 15, 2004

(30) Foreign Application Priority Data

Jul. 17, 2002 (JP) ..... 2002-208797

(51) Int. Cl.[7] ..... B41J 2/435; B41J 2/47

(52) U.S. Cl. ..... 347/234; 347/233; 347/235; 347/237; 347/240; 347/250; 347/251; 358/520; 358/504; 250/208.1; 250/205

(58) Field of Search ..... 347/233, 234, 347/235, 236, 237, 240, 246, 249, 250, 251; 250/205, 208.1; 358/504, 520; 382/266; 359/196, 204

(56) References Cited

U.S. PATENT DOCUMENTS 5,091,971 A * 2/1992 Ward et al. ..... 382/266
5,566,372 A * 10/1996 Ikeda et al. ..... 399/46
5,700,610 A * 12/1997 Bosschaerts et al. ..... 430/30
6,137,518 A 10/2000 Maeda
6,208,449 B1 * 3/2001 Suzuki ..... 359/196
6,249,304 B1 6/2001 Sawayama et al.
6,292,206 B1 9/2001 Takehara et al.
6,323,889 B1 * 11/2001 Miura ..... 347/234
6,384,856 B2 * 5/2002 Nakagawa et al. ..... 347/233
6,476,370 B1 * 11/2002 Suzuki et al. ..... 250/208.1
6,654,041 B2 * 11/2003 Takesue ..... 347/234
2002/0043611 A1 * 4/2002 Yoshikawa et al. ..... 250/208.1
2002/0063770 A1 * 5/2002 Takesue ..... 347/234

* cited by examiner

*Primary Examiner*—Eugene H. Eickholt
(74) *Attorney, Agent, or Firm*—Oblon, Spivak, McClelland, Maier & Neustadt, P.C.

(57) ABSTRACT

An image forming apparatus is constructed to include an image bearing member which is rotatably supported to bear a toner image, a light beam scanning section to simultaneously scan the image bearing member by a plurality of light beams so as to form an electrostatic latent image, a developing section to develop the electrostatic latent image into the toner image, a transfer section to transfer the toner image onto a recording medium, and an ON start timing adjuster to adjust an ON start timing of one of the plurality of light beams, based on an image tone of each of a plurality of patterns of an image pattern formed by the light beam scanning section.

30 Claims, 18 Drawing Sheets

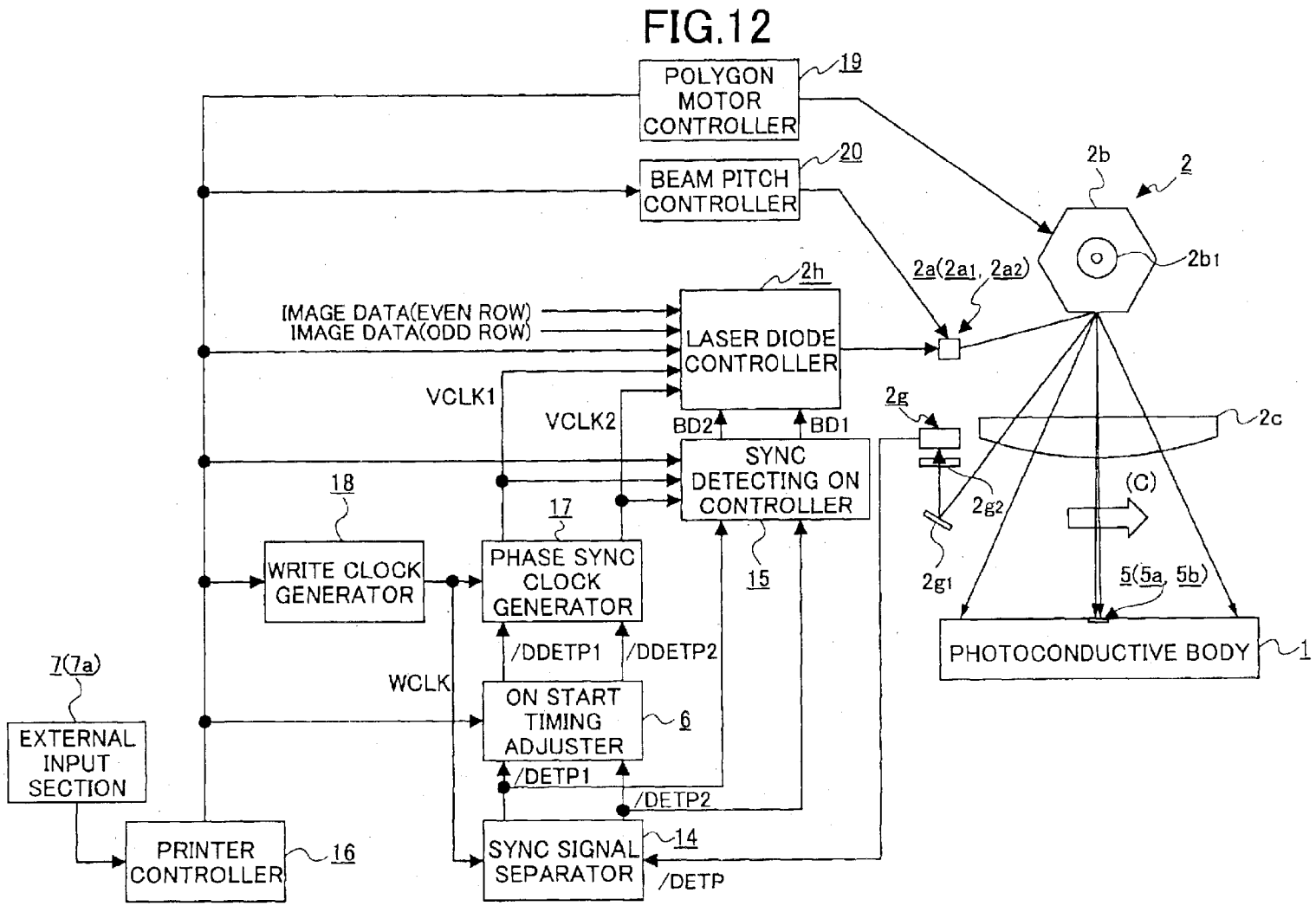
FIG.12
POLYGON MOTOR CONTROLLER
19
BEAM PITCH CONTROLLER
20
2
2b
2b1
2a(2a1, 2a2)
2h
LASER DIODE CONTROLLER
BD1
BD2
SYNC DETECTING ON CONTROLLER
15
2c
2g
2g1
2g2
(C)
5(5a, 5b)
PHOTOCONDUCTIVE BODY
1
IMAGE DATA(EVEN ROW)
IMAGE DATA(ODD ROW)
VCLK1
VCLK2
17
PHASE SYNC CLOCK GENERATOR
/DDETP1
/DDETP2
6
ON START TIMING ADJUSTER
/DETP1
/DETP2
14
SYNC SIGNAL SEPARATOR
/DETP
WCLK
18
WRITE CLOCK GENERATOR
16
PRINTER CONTROLLER
7(7a)
EXTERNAL INPUT SECTION

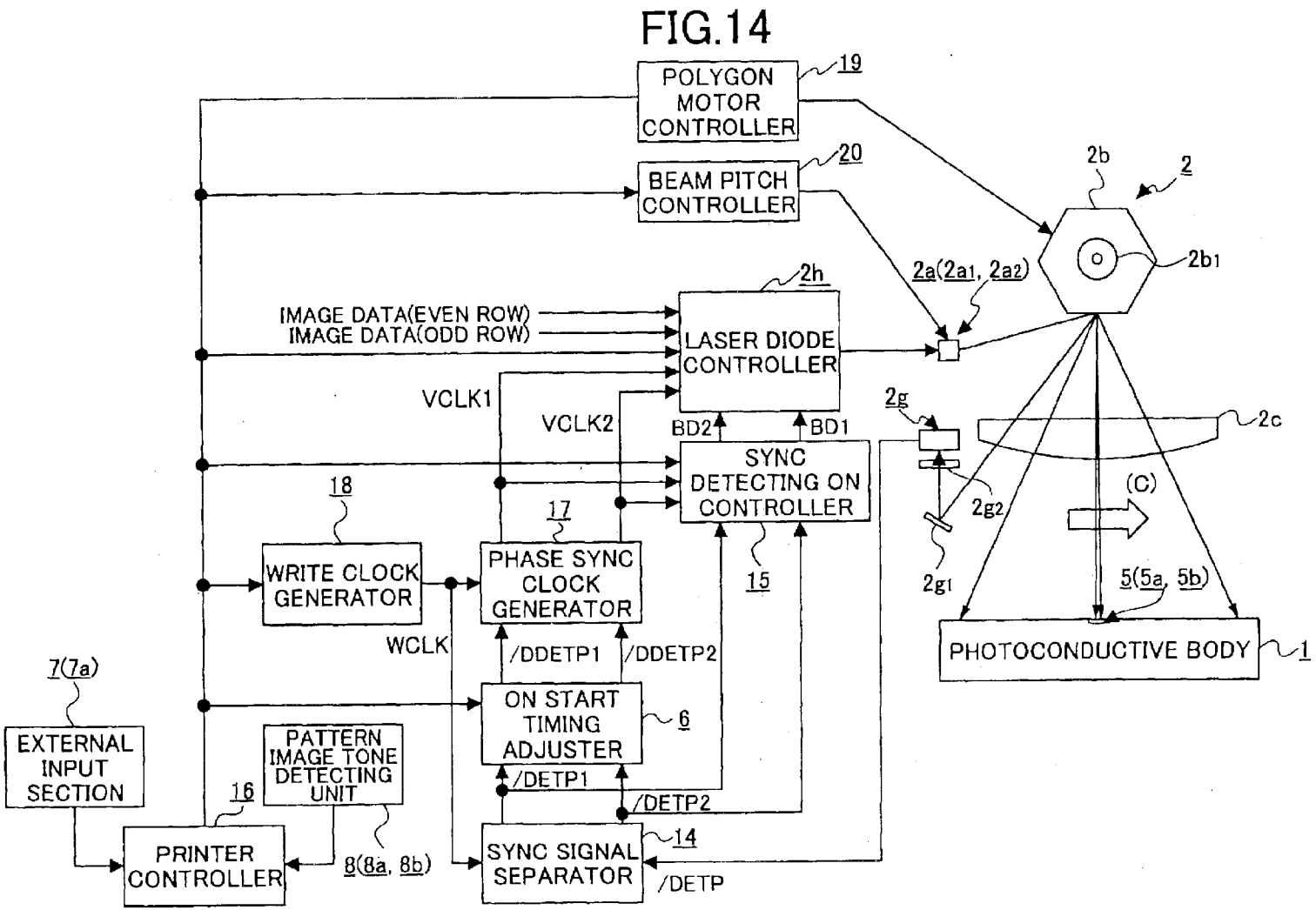
FIG.14
POLYGON MOTOR CONTROLLER
19
BEAM PITCH CONTROLLER
20
2
2b
2b1
2a(2a1, 2a2)
2h
LASER DIODE CONTROLLER
BD1
BD2
SYNC DETECTING ON CONTROLLER
15
2g
2g1
2g2
2c
(C)
5(5a, 5b)
PHOTOCONDUCTIVE BODY
1
IMAGE DATA(EVEN ROW)
IMAGE DATA(ODD ROW)
VCLK1
VCLK2
17
PHASE SYNC CLOCK GENERATOR
/DDETP1
/DDETP2
6
ON START TIMING ADJUSTER
/DETP1
/DETP2
14
SYNC SIGNAL SEPARATOR
/DETP
WCLK
18
WRITE CLOCK GENERATOR
PATTERN IMAGE TONE DETECTING UNIT
8(8a, 8b)
16
PRINTER CONTROLLER
7(7a)
EXTERNAL INPUT SECTION

IMAGE FORMING APPARATUS

BACKGROUND OF THE INVENTION

This application claims the benefit of a Japanese Patent Application No. 2002-208797 filed Jul. 17, 2002, in the Japanese Patent Office, the disclosure of which is hereby incorporated by reference.

1. Field of the Invention

The present invention generally relates to image forming apparatuses, and more particularly to an image forming apparatus, such as a copying machine, a facsimile apparatus, a printer and a composite apparatus, using a plurality of simultaneously scanning light beams to form a toner image.

In this specification, a composite apparatus refers to an apparatus having composite functions, that is, the functions of two or more apparatuses selected from the copying machine, the facsimile machine and the printer.

2. Description of the Related Art

Conventionally, there is an image forming apparatus, such as a copying machine, a facsimile machine, a printer and a composite apparatus, which is provided with a plurality of semiconductor laser (laser diodes, LDs) as light sources. In such an image forming apparatus, each light beam emitted from the light source makes a scan in a main scan direction by being deflected by a deflecting means which is formed by a rotary polygon mirror having a plurality of mirror surfaces. In addition, scan positions of each of the light beams on a scanning surface are separated in a sub scan direction by a predetermined pitch, so that a plurality of lines can be scanned simultaneously in the main scan direction. According to this recording method, it is possible to improve the recording speed without having to increase the rotational speed of the rotary polygon mirror. However, a satisfactory image cannot be recorded unless write start positions of each of the light beams are correctly aligned.

For example, in the case of the image forming apparatus using two light beams, a synchronization detecting sensor is provided to detect the two light beams. A synchronization detection signal corresponding to each light beam is output from the synchronization detecting sensor when each light beam traverses the synchronization detecting sensor. Hence, generally, an image write start timing of each light beam is determined by the timing of the corresponding synchronization detection signal.

The two light beams traverse the synchronization detecting sensor at a certain time interval therebetween. Accordingly, the synchronization detection signals corresponding to the two light beams have a timing difference corresponding to the certain time interval. No problems will occur if the timing difference between the two light beams detected by the synchronization detecting sensor is identical to the timing difference between the two light beams scanning a photoconductive body. However, if an optical path length from the light source to the synchronization detecting sensor and an optical path length from the light source to the photoconductive body even slightly differ, the timing difference between the two light beams detected by the synchronization detecting sensor and the timing difference between the two light beams scanning the photoconductive body become different, to thereby make the image write start positions of the two light beams different. If the image write start positions of the two light beams are different, the picture quality of the recorded image deteriorates because even a difference on the order of several $\mu$m between the image write start positions of the two light beams causes a difference in the image tones recorded thereby.

A Japanese Laid-Open Patent Application No. 2000-292720 proposes a method of suppressing a relative error of light beams in the main scan direction, in an image forming apparatus which forms an image on a recording medium by scanning a rotary photoconductive body by a plurality of light beams deflected by a polygon mirror. According to this proposed method, the relative error between one light beam and another light beam in the main scan direction is measured, and write start timings of the one light beam and the other light beam are electrically corrected depending on the measured relative error.

But in actual practice, the amount of error between the light beams is on the order of one dot or less, and an expensive high-precision measuring device is required to measure such a small amount. As a result, in order to correct the relative error between the plurality of light beams and to suppress deterioration of the picture quality of the toner image which is recorded by simultaneously scanning the photoconductive body by the plurality of light beams, there were problems in that it is necessary to provide the expensive high-precision measuring device to measure the extremely small amount of error between the light beams, and the cost of the image forming apparatus becomes high.

SUMMARY OF THE INVENTION

Accordingly, it is a general object of the present invention to provide a novel and useful image forming apparatus in which the problems described above are eliminated.

Another and more specific object of the present invention is to provide an image forming apparatus which can positively and easily correct errors of a plurality of light beams in a main scan direction when forming a toner image by simultaneously scanning a photoconductive body by the plurality of light beams, and form an image having a high picture quality at a low cost.

Still another and more specific object of the present invention is to provide an image forming apparatus is constructed to include an image bearing member which is rotatably supported to bear a toner image, a light beam scanning section to simultaneously scan the image bearing member by a plurality of light beams so as to form an electrostatic latent image, a developing section to develop the electrostatic latent image into the toner image, a transfer section to transfer the toner image onto a recording medium, and an ON start timing adjuster to adjust an ON start timing of one of the plurality of light beams, based on an image tone of each of a plurality of patterns of an image pattern formed by the light beam scanning section. According to the image forming apparatus of the present invention, it is possible to positively and easily correct errors of a plurality of light beams in a main scan direction when forming a toner image by simultaneously scanning an image bearing member, such as a photoconductive drum body, by the plurality of light beams, and form an image having a high picture quality at a low cost. In addition, the present invention may be applied to formation of a monochrome (black-and-white) image and a color image.

A further object of the present invention is to provide the image forming apparatus of the type described above, wherein the image pattern includes first patterns and second patterns; the first patterns being formed by shifting a first light beam in a main scan direction by one dot with respect to a second light beam and repeating an image pattern formed thereby in a sub scan direction, and further repeating an image pattern formed thereby in the main scan direction at intervals of n dots; the second patterns being formed by shifting the first light beam in a direction opposite to the main scan direction by one dot with respect to the second light beam and repeating an image pattern formed thereby in the sub scan direction, and further repeating an image pattern formed thereby in the main scan direction at intervals of n dots, where the main and sub scan directions are approximately perpendicular to each other, and n is greater than or equal to one. According to the image forming apparatus of the present invention, it is possible to easily detect an image tone difference or a latent image potential difference of the first and patterns, so that the ON start timing may be adjusted by the ON start timing adjuster based on the detected image tone difference or latent image potential difference.

Other objects and further features of the present invention will be apparent from the following detailed description when read in conjunction with the accompanying drawings.

BRIEF DESCRIPTION OF THE DRAWINGS

FIG. 12 is a system block diagram showing a third embodiment of the image forming apparatus;

FIG. 14 is a system block diagram showing an important part of the fourth embodiment of the image forming apparatus;

DESCRIPTION OF THE PREFERRED EMBODIMENTS

Figure 1:
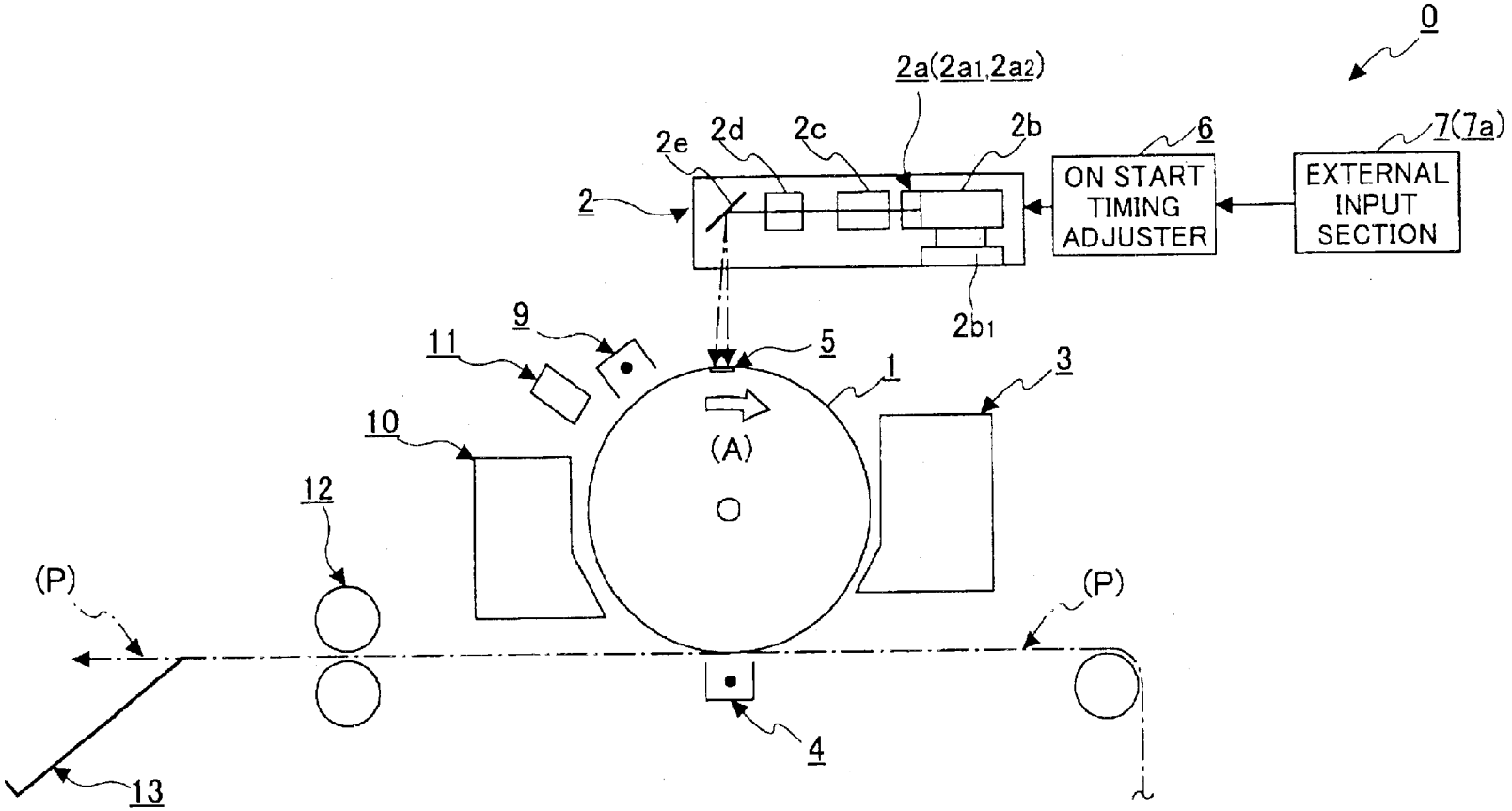
FIG. 1 is a diagram showing a first embodiment of an image forming apparatus according to the present invention.

FIG. 1 is a diagram showing a first embodiment of an image forming apparatus according to the present invention. In this first embodiment of the image forming apparatus, the present invention is applied to a monochrome or black-and-white printer. An image forming apparatus 0 shown in FIG. 1 forms a toner image by simultaneously scanning a photoconductive body (image bearing member) 1 by a plurality of light beams. The photoconductive body 1 has a drum shape and is rotatable in a direction (A) shown in FIG. 1. A light beam scanning unit 2 forms an electrostatic latent image on the photoconductive body 1 by simultaneously scanning the photoconductive body 1 by the plurality of light beams. A developing unit 3 forms the toner image on the photoconductive body 1 by supplying a toner and developing the electrostatic latent image. A transfer unit 4 transfers the toner image which is formed on the photoconductive body 1 onto a recording medium (P) such as paper. The light beam scanning unit 2 forms an image pattern 5 made up of a plurality of patterns, and an ON start timing adjusting unit 6 adjusts an ON start timing of one of the plurality of light beams using an image tone of each of the plurality of patterns of the image pattern 5. When forming the toner image by simultaneously scanning the photoconductive body 1 by the plurality of light beams, errors of the plurality of light beams in a main scan direction are positively and easily corrected, so that an image having a high picture quality can be formed on the recording medium (P) at a low cost.

In the light beam scanning unit 2, laser diodes **2*a*1 and 2*a*2 of a laser diode unit 2*a* are turned ON depending on image data. Light beams from the laser diodes 2*a*1 and 2*a*2 are formed into parallel rays by a collimator lens (not shown), and are deflected by a polygon mirror 2*b* via a cylindrical lens (not shown). The polygon mirror 2*b* is rotated by a polygon motor 2*b*1. The deflected light beams from the polygon mirror 2*b* pass through an fθ lens 2*c* and a barrel toroidal lens 2*d*, and are reflected by a mirror 2*e* to scan the photoconductive body 1. The barrel toroidal lens 2*d*** is provided for focusing in a sub scan direction which is approximately perpendicular to the main scan direction, converging light, and for correcting position such as surface wobbling in the sub scan direction.

A charging unit 9, the developing unit 3, the transfer unit 3, a cleaning unit 10, and a discharge unit 11 are provided around the photoconductive body 11. By carrying out a normal electrophotography process including charging, exposure, developing and transfer, the toner image on the photoconductive body 1 is transferred onto the recording medium (P) which is transported by a known means (not shown). A fixing unit 12 fixes the toner image on the recording medium (P), and the recording medium (P) having the fixed image is ejected onto an eject tray 13 by a known means (not shown).

Figure 2:
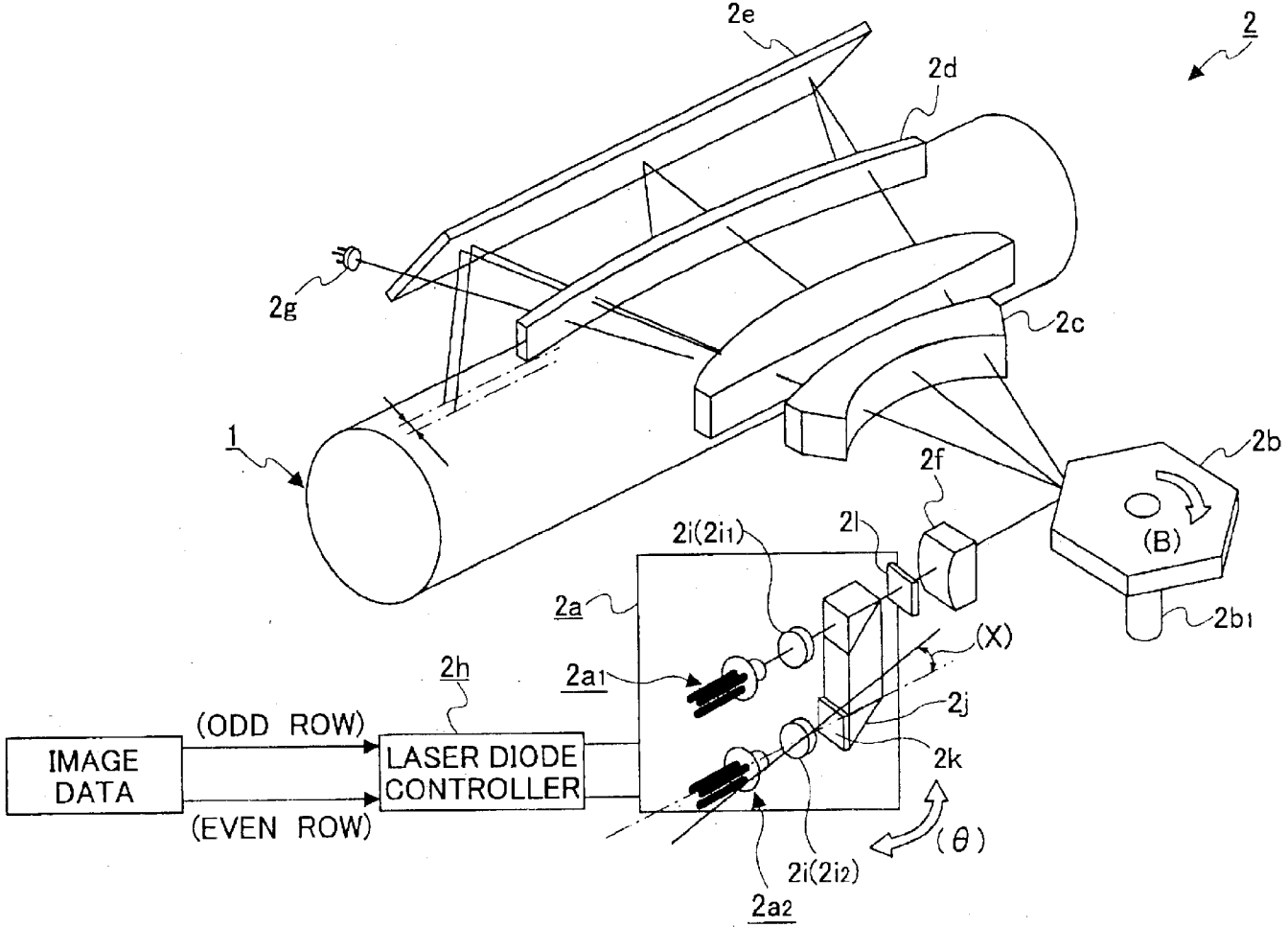
FIG. 2 is a perspective view showing an important part of the first embodiment of the image forming apparatus.

FIG. 2 is a perspective view showing an important part of the first embodiment of the image forming apparatus shown in FIG. 1. In FIG. 2, the laser diode unit **2*a* of the light beam scanning unit 2 is driven and modulated depending on the image data, and the light beams are emitted from the laser diodes 2a1 and 2a2. The cylindrical lens 2f is provided in an optical path of the light beams which are emitted from the laser diodes 2a1 and 2a2 towards the polygon mirror 2b. The polygon mirror 2b is rotated at a high speed in a direction (B) shown in FIG. 2 by the polygon motor 2b1. A plurality of mirror surfaces of the polygon mirror 2b which is rotated deflects the light beams within a horizontal plane, so as to scan the photoconductive body 1. The polygon mirror 2b and the polygon motor 2b1 form a deflector unit. In this embodiment, the polygon mirror 2b** has six mirror surfaces.

A scanning lens structure which is formed by the fθ lens 2c and the barrel toroidal lens 2d, and the mirror 2e are arranged in sequence in an optical path from the polygon mirror 2b towards the photoconductive body 1. The scanning lens structure and the mirror 2e are set to image the scanning light beams on the surface of the photoconductive body 1.

A synchronization detecting sensor 2g is provided at a position preceding an image write start position in a non-image write region in the main scan direction. The synchronization detecting sensor 2g detects the light beam which is deflected by the polygon mirror 2b and outputs a synchronization detection signal for controlling a write start timing in the main scan direction.

The laser diode unit 2a forms a multi-beam light source which is capable of simultaneously emitting a plurality of light beams. In this embodiment, the laser diode unit 2a simultaneously emits two light beams. The two laser diodes 2a1 and 2a2 are provided as light emitting sources which are independently controlled of the ON-state by a laser diode controller 2h. The multi-beam light source combines and emits the two light beams emitted from the two laser diodes 2a1 and 2a2 as if the two light beams were emitted from a single light source.

Next, a description will be given of the operating principle of the laser diode unit 2a for combining the two light beams. In this embodiment, the image data is divided into odd numbered rows and even numbered rows, and the laser diode controller 2h turns ON the laser diodes 2a1 and 2a2 depending on the image data. The light beam emitted from the laser diode 2a1 is converted into a parallel ray by a collimator lens 2i1 of a collimator lens structure 2i, and reaches a beam combining prism 2j. The light beam emitted from the laser diode 2a2 is converted into a parallel ray by a collimator lens 2i2 of the collimator lens structure 2i, but the light beam is inclined by an angle (X) with respect to the light beam emitted from the laser diode 2a1. Hence, the light beam which is inclined by the angle (X) with respect to the light beam emitted from the laser diode 2a1 is deflected by a λ/2 plate 2k before reaching the beam combining prism 2j.

The beam combining prism 2j transmits the light beam emitted from the laser diode 2a1, but reflects the light beam emitted from the laser diode 2a2 because the light beam emitted from the laser diode 2a2 is deflected by 90 degrees. As a result, both the light beams emitted from the laser diodes 2a1 and 2a2 are output from the beam combining prism 2j. When the two light beams output from the beam combining prism 2j are passed through a λ/2 plate 21, so that the deflection states of the light beams emitted from the laser diodes 2a1 and 2a2 approach each other.

The laser diode unit 2a itself, which is formed by the optical elements described above, is capable of freely tilting by an inclination angle (θ) about an optical axis of the light beam emitted from the laser diode 2a1.

Accordingly, when the light beam emitted from the laser diode 2a2 is inclined and incident to the beam combining prism 2j at the angle (X), the light beam emitted from the laser diode 2a1 and the light beam emitted from the laser diode 2a2 deviate in the main scan direction. Furthermore, a deviation between the light beam emitted from the laser diode 2a1 and the light beam emitted from the laser diode 2a2 in the sub scan direction is determined by the inclination angle (θ) of the laser diode unit 2a itself.

Figure 3:
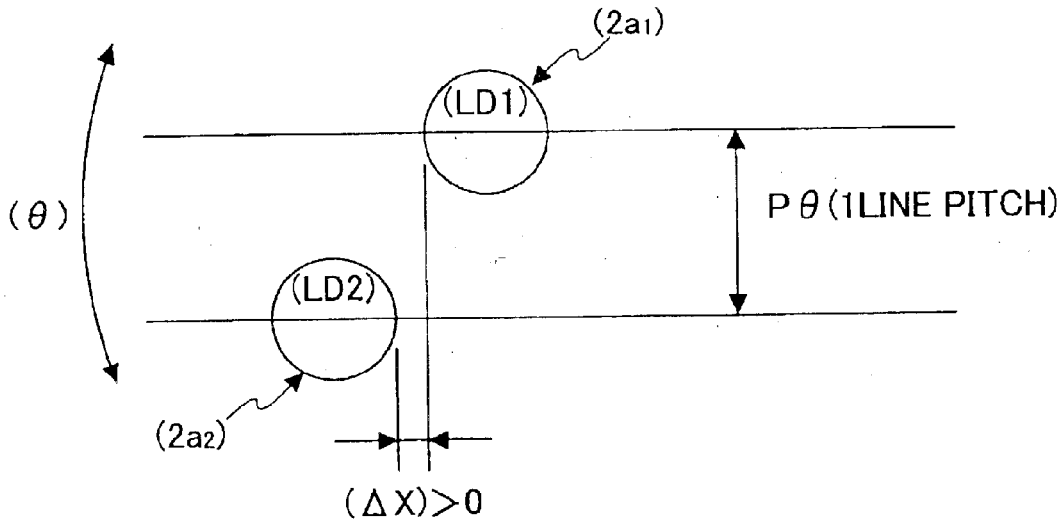
FIG. 3 is a diagram showing another important part of the first embodiment of the image forming apparatus on an enlarge scale.

FIG. 3 is a diagram showing another important part of the first embodiment of the image forming apparatus shown in FIG. 1 on an enlarged scale. More particularly, FIG. 3 shows a positional relationship of the two light beams emitted from the laser diodes 2a1 and 2a2. The two light beams emitted from the laser diodes 2a1 and 2a2 simultaneously scan the photoconductive body 1, and the two light beams are detected by the same synchronization detecting sensor 2g (not shown in FIG. 3). Hence, a deviation (or amount of error) Δx between the two light beams in the main scan direction, should be greater than zero when detected by the synchronization detecting sensor 2g.

Circular beam spots LD1 and LD2 take into consideration a spreading of the two light beams emitted from the laser diodes 2a1 and 2a2. Hence, if (Δx)>0, the two light beams emitted from the laser diodes 2a1 and 2a2 can be detected by the synchronization detecting sensor 2g (not shown in FIG. 3). Therefore, if Pθ=1 line pitch (42.3 μm in the case of 600 dpi), the angles (X) and (θ) are adjusted so that the relationship (Δx)>0 is satisfied.

Figure 4:
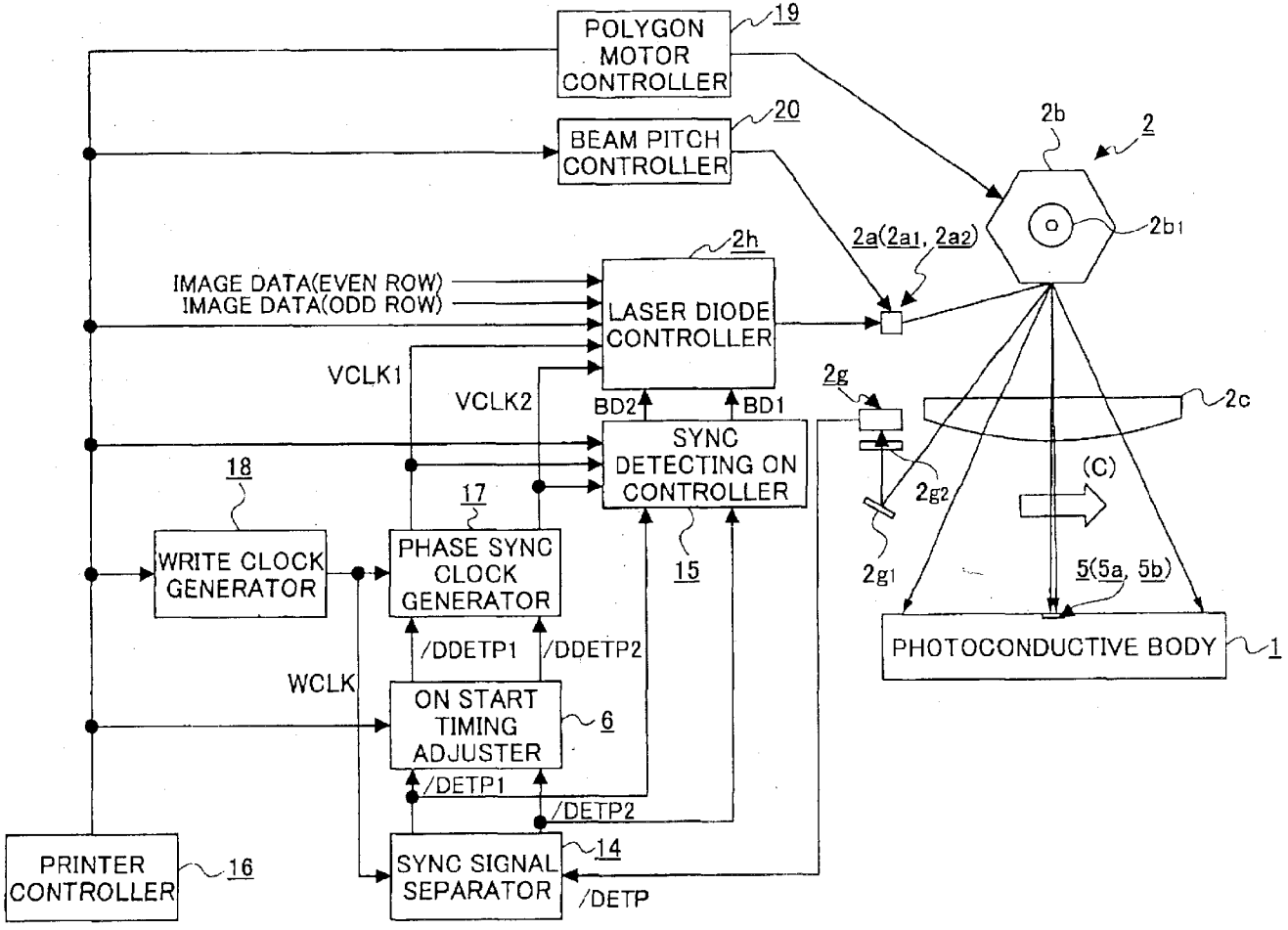
FIG. 4 is a system block diagram showing another important part of the first embodiment of the image forming apparatus.
Figure 5:
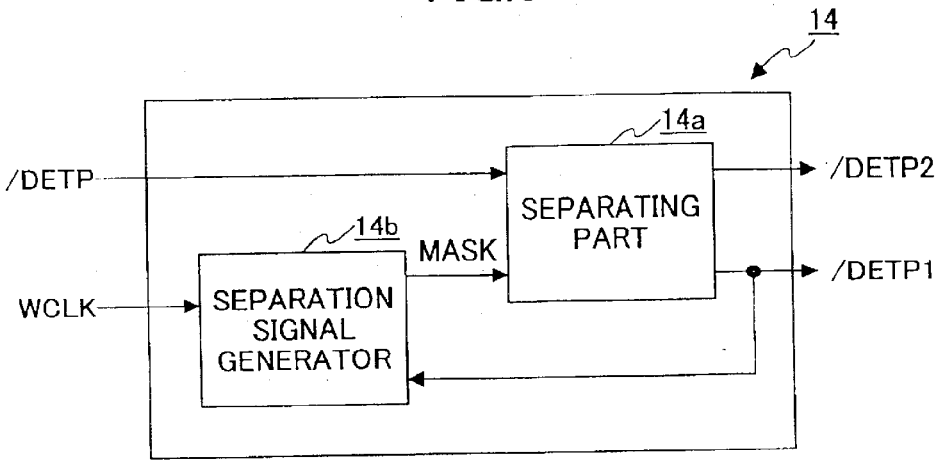
FIG. 5 is a system block diagram showing another important part of the first embodiment of the image forming apparatus.
Figure 6:
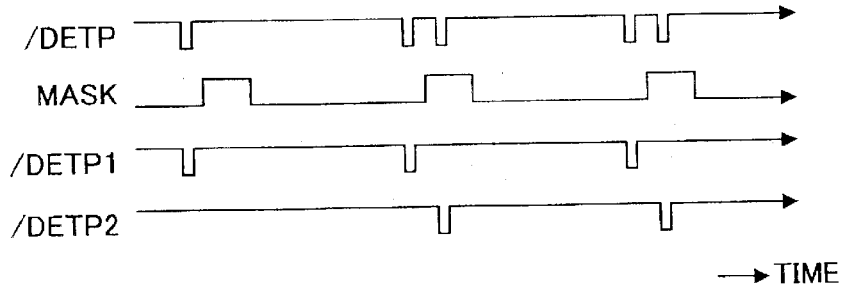
FIG. 6 is a timing chart for explaining the operation of the first embodiment of the image forming apparatus.
Figure 7:
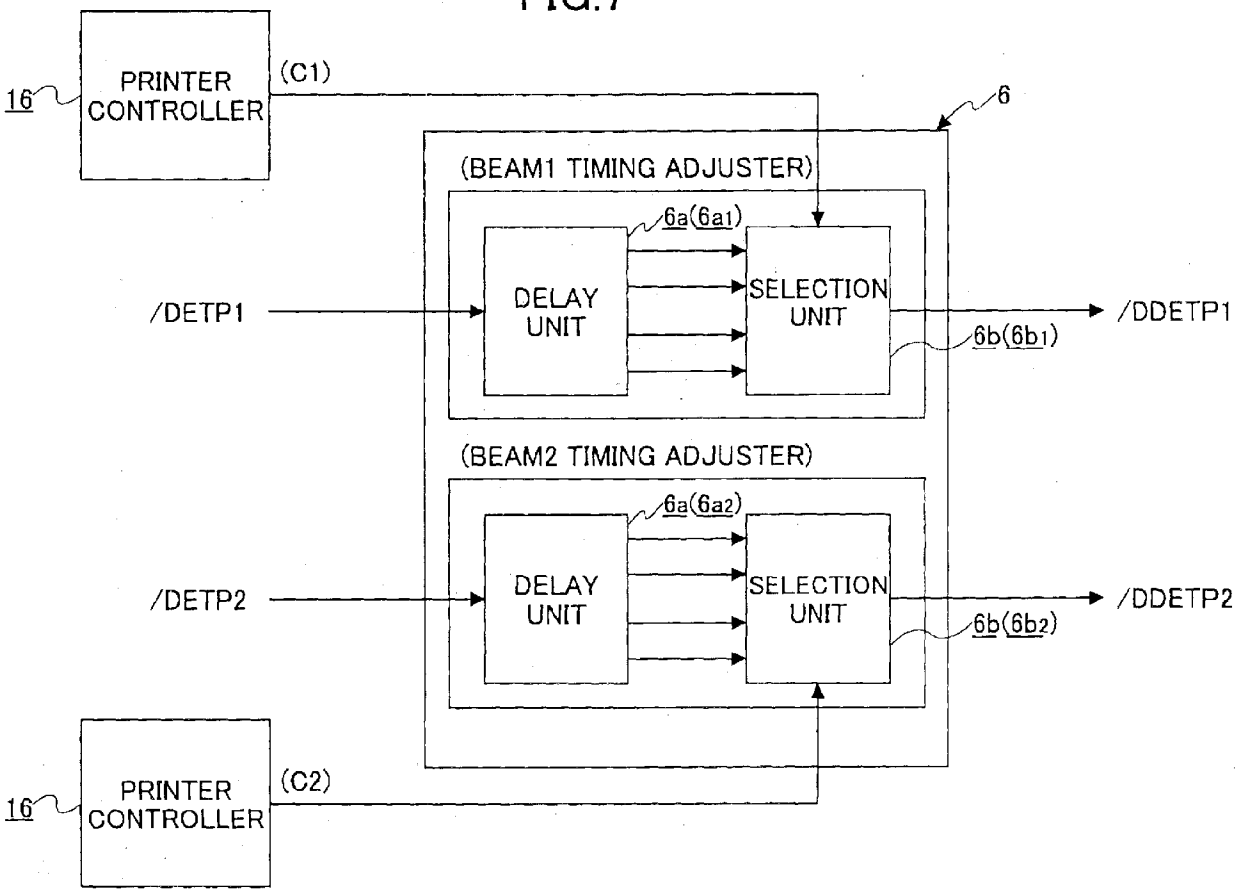
FIG. 7 is a system block diagram showing another important part of the first embodiment of the image forming apparatus.

Next, a description will be given of other parts of the first embodiment of the image forming apparatus shown in FIG. 1, by referring to FIGS. 4 through 7. FIG. 4 is a system block diagram showing another important part of the first embodiment of the image forming apparatus, and FIG. 5 is a system block diagram showing another important part of the first embodiment of the image forming apparatus. FIG. 6 is a timing chart for explaining the operation of the first embodiment of the image forming apparatus, and FIG. 7 is a system block diagram showing another important part of the first embodiment of the image forming apparatus.

In FIG. 4, the synchronization detecting sensor 2g for detecting the two light beams emitted from the laser diodes 2a1 and 2a2 of the laser diode unit 2a is provided on an image write start position side of the light beam scanning unit 2 in the main scan direction which is indicated by an arrow (C). The two light beams emitted from the laser diodes 2a1 and 2a2 pass through the fθ lens 2c, and are reflected by a mirror 2g1. The light beams reflected by the mirror 2g1 are converged by a lens 2g2 to reach the synchronization detecting sensor 2g.

A synchronization detection signal /DETP shown in FIG. 6 output from the synchronization detecting sensor 2g is supplied to a synchronizing signal separator 14, and separated into synchronizing signals /DETP1 and /DETP2 shown in FIG. 6 respectively corresponding to the laser diodes 2a1 and 2a2.

Immediately after a print operation is started, only the laser diode 2a1 of the laser diode unit 2a is turned ON. Hence, in the synchronizing signal separator 14 shown in FIG. 5, a separating part 14a which is formed by a gate circuit passes the synchronization detection signal /DETP as it is as the synchronizing signal /DETP1. This synchronizing signal /DETP1 is supplied to a separation signal generator 14b which generates a separation signal MASK shown in FIG. 6. The separation signal generator 14b is formed by a counter which counts up the synchronizing signal /DETP1 in response to a write clock WCLK and a comparator. The separation signal MASK turns ON (in this case, assumes a high level) at a predetermined timing from the synchronizing signal /DETP1 and turns OFF (in this case, assumes a low level) after a predetermined time. All the separation signal MASK is required to have are rise and fall timings which enable positive separation of the synchronizing signals /DETP1 and /DETP2.

By generating the separation signal MASK, both the laser diodes 2*a*1 and 2*a*2 of the laser diode unit 2*a* are turned ON from the next scan. By supplying the synchronization detection signal /DETP and the separation signal MASK to the separating part 14*a*, it is possible to separate the synchronization detection signal /DETP into the synchronizing signals /DETP1 and /DETP2. The synchronizing signals /DETP1 and /DETP2 are supplied to an ON start timing adjuster 6 and a synchronization detecting ON controller 15 shown in FIG. 4.

The ON start timing adjuster 6 includes a delay unit 6*a* having delays 6*a*1 and 6*a*2, and a selection unit 6*b* having selectors 6*b*1 and 6*b*2, as shown in FIG. 7. The synchronizing signal /DETP1 is supplied to the delay 6*a*1, so as to generate a signal having the timing of the synchronizing signal /DETP1 and signals having timings with various delays from the synchronizing signal /DETP1. Similarly, the synchronizing signal /DETP2 is supplied to the delay 6*a*2, so as to generate a signal having the timing of the synchronizing signal /DETP2 and signals having timings with various delays from the synchronizing signal /DETP2. The signals generated from the delay 6*a*1 are supplied to the selector 6*b*1, and the signals generated from the delay 6*a*2 are supplied to the selector 6*b*2. The selector 6*b*1 selects and outputs one of the signals from the delay 6*a*1 based on a correction data C1 from a printer controller 16, as a signal /DDETP1. Similarly, the selector 6*b*2 selects and outputs one of the signals from the delay 6*a*2 based on a correction data C2 from the printer controller 16, as a signal /DDETP2.

In FIG. 4, a phase synchronizing clock generator 17 generates clocks VCLK1 and VCLK2 which are respectively synchronized to the signals /DDETP1 and /DDETP2, based on a clock WCLK which is generated by a write clock generator 18 and the signals /DDETP1 and /DDETP2 which are generated by the ON start timing adjuster 6. The clocks VCLK1 and VCLK2 are supplied to the laser diode controller 2*h* and the synchronization detecting ON controller 15.

In order to first detect the synchronizing signal /DETP1 corresponding to the laser diode 2*a*1 of the laser diode unit 2, the synchronization detecting ON controller 15 turns ON a laser diode ON signal BD1 for forcibly turning ON the laser diode 2*a*1. Hence, the laser diode 2*a*1 is forcibly turned ON. However, after the synchronizing signal /DETP1 is detected, the synchronization ON controller 15 generates a laser diode ON signal BD1 for turning ON the laser diode 2*a*1 at a timing which enables positive detection of the synchronizing signal /DETP1 but to an extent which generates no flare light, based on the synchronizing signal /DETP1 and the clock VCLK.

In addition, the synchronization ON controller 15 generates a laser diode ON signal BD2 for forcibly turning ON the laser diode 2*a*2 of the laser diode unit 2*a*, which turns ON at a predetermined timing after detecting the synchronizing signal /DETP1, to enable positive detection of the synchronizing signal /DEPT2 corresponding to the laser diode 2*a*2. The laser diode ON signals BD1 and BD2 are supplied to the laser diode controller 2*h*.

The laser diode controller 2*h* controls the ON timings of the laser diodes 2*a*1 and 2*a*2 of the laser diode unit 2*a*, depending on the laser diode ON signals BD1 and BD2 and the image data (even numbered rows and odd numbered rows) synchronized to the clocks VCLK1 and VCLK2.

Hence, the laser diodes 2*a*1 and 2*a*2 of the laser diode unit 2*a* emit light beams which are deflected by the polygon mirror 2*b*. The deflected light beams pass through the fθ lens 2*c* and the like, and the light beams finally scan the surface of the photoconductive body 1.

A polygon motor controller 19 controls the polygon motor 2*b*1 to rotate at a predetermined rotational speed, based on a control signal from the printer controller 16.

A beam pitch controller 20 is provided to variably control a beam pitch of the light beams emitted from the laser diodes 2*a*1 and 2*a*2 of the laser diode unit 2*a*. The beam pitch controller 20 varies the beam pitch of the light beams emitted from the laser diodes 2*a*1 and 2*a*2, in response to an instruction from the printer controller 16.

A varying means for varying the angle (θ) of the laser diode unit 2*a* is not shown. However, in FIG. 2, it is possible to provide a pulse motor for varying the angle (θ) of the laser diode unit 2*a*, for example. In this case, the angle (θ) of the laser diode unit 2*a* may be varied by varying a number of pulses supplied to the stepping motor to rotate the stepping motor.

By obtaining the relationship between the number of pulses and the beam pitch in advance, it is possible to supply the corresponding number of pulses to the stepping motor from the beam pitch controller 20 when actually setting the beam pitch.

In a case where the beam pitch is not variably controlled but is set to a fixed pitch, there is no need to provide the beam pitch controller 20 and the varying means described above. In this case, an adjusting tool or the like may be used to adjust the beam pitch to a predetermined value when forwarding the image forming apparatus from the factory.

Figure 8:
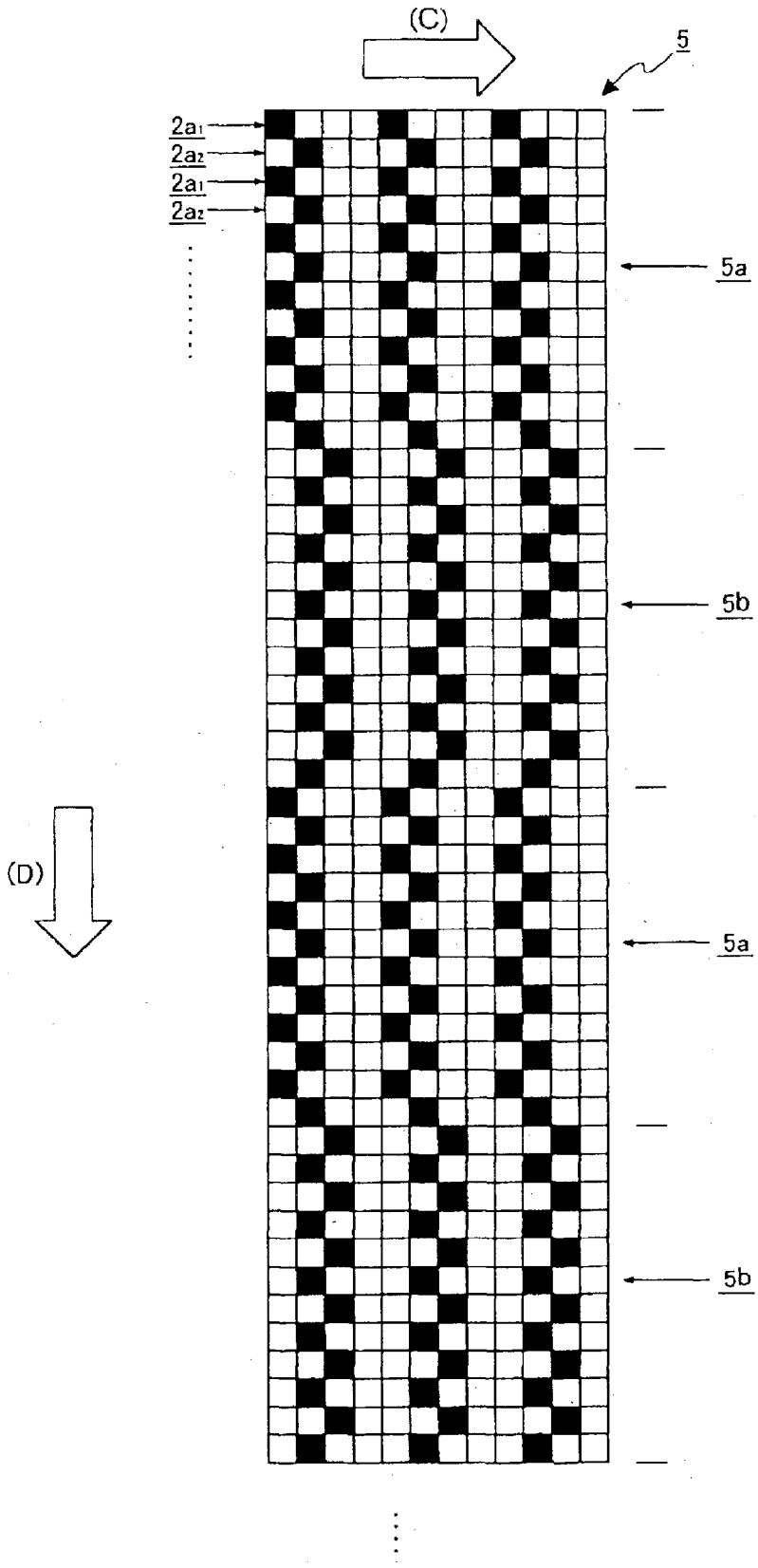
FIG. 8 is a diagram for explaining an image pattern used in the first embodiment of the image forming apparatus.

FIG. 8 is a diagram for explaining an image pattern used in the first embodiment of the image forming apparatus. The image pattern 5 shown in FIG. 8 includes first patterns 5*a* and second patterns 5*b* which are repeated in the sub scan direction indicated by an arrow (D). The first patterns 5*a* are formed by shifting the light beam emitted from the laser diode 2*a*2 in the main scan direction indicated by the arrow (C) by one dot with respect to the light beam emitted from the laser diode 2*a*1, and repeating the image pattern formed thereby in the main scan direction and the sub scan direction. The second patterns 5*b* are formed by shifting the light beam emitted from the laser diode 2*a*2 in a direction opposite to the main scan direction indicated by the arrow (C) by one dot with respect to the light beam emitted from the laser diode 2*a*1, and repeating the image pattern formed thereby in the main scan direction and the sub scan direction. Area ratios of the images are the same for the first and second patterns 5*a* and 5*b*, and thus, image tones of the first and second patterns 5*a* and 5*b* are normally the same.

Figure 9:
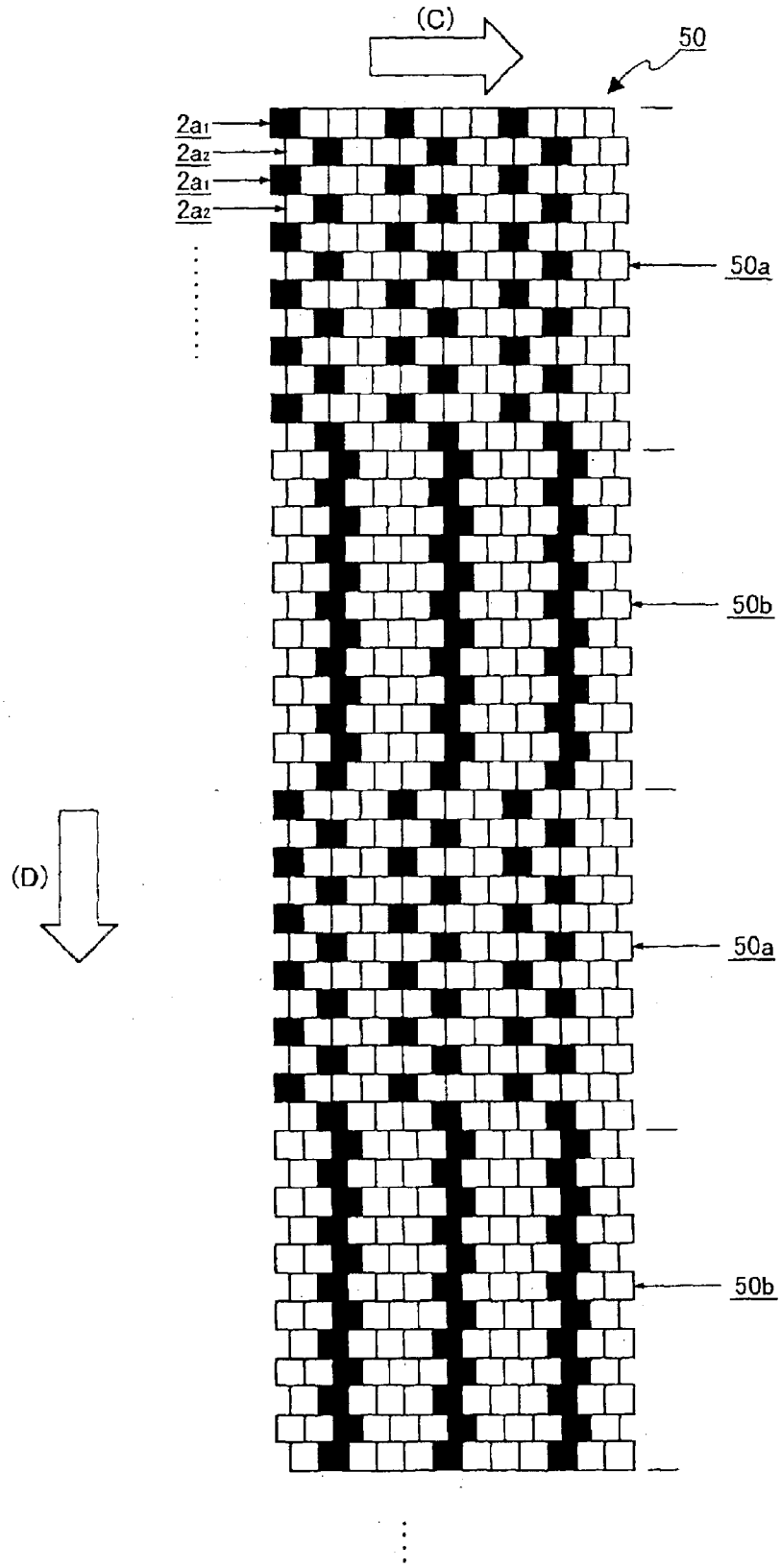
FIG. 9 is a diagram for explaining another image pattern used in the first embodiment of the image forming apparatus.

FIG. 9 is a diagram for explaining another image pattern used in the first embodiment of the image forming apparatus. An image pattern 50 shown in FIG. 9 includes first patterns 50*a* and second patterns 50*b* which are repeated in the sub scan direction indicated by the arrow (D). The first patterns 50*a* are formed by shifting the light beam emitted from the laser diode 2*a*2 in the main scan direction indicated by the arrow (C) by one-half dot with respect to the light beam emitted from the laser diode 2*a*1, and repeating the image pattern formed thereby in the main scan direction and the sub scan direction. The second patterns 50*b* are formed by shifting the light beam emitted from the laser diode 2*a*2 in a direction opposite to the main scan direction indicated by the arrow (C) by one-half dot with respect to the light beam emitted from the laser diode 2*a*1, and repeating the image pattern formed thereby in the main scan direction and the sub scan direction.

In the first patterns 50*a*, the dots are isolated or separated from each other, and the image tone becomes lighter than normal. On the other hand, in the second patterns 50*b*, the dots are connected, and the image tone becomes darker than that of the first patterns 50*a*.

Since the first patterns 50*a* and the second patterns 50*b* are alternately repeated in the image pattern 50, the difference in the image tone appears in the form of stripes, and it is easy to detect the image tone difference.

When the image pattern 50 is actually output and no image tone difference is detected, there is no need for adjustment. But if the image tone difference is detected in the image pattern 50 which is actually output, an ON start timing of the synchronizing signal /DETP1 for the laser diode 2*a*1 or the synchronizing signal /DETP2 for the laser diode 2*a*2 is adjusted, and the adjustment is repeated until the image tone difference becomes tolerable (until the image tone difference falls within a tolerable range).

Therefore, the image pattern 5 may include the first patterns 5*a* and the second patterns 5*b*. The first patterns 5*a* may be formed by shifting a first light beam in the main scan direction by one dot with respect to a second light beam and repeating an image pattern formed thereby in the sub scan direction, and further repeating an image pattern formed thereby in the main scan direction at intervals of n dots, where n is greater than or equal to one. In addition, the second patterns 5*b* may be formed by shifting the first light beam in a direction opposite to the main scan direction by one dot with respect to the second light beam and repeating an image pattern formed thereby in the sub scan direction, and further repeating an image pattern formed thereby in the main scan direction at intervals of n dots.

In the delay unit 6*a* of the ON start timing adjuster 6, the alternatives increase and the deterioration of the picture quality can be suppressed more if the delay time is shorter and the number of generated signals is larger. Accordingly, the delay time and the number of signals to be generated may be determined based on the tolerable image tone difference and the deviation (amount of error) of the two light beams for the tolerable image tone difference as well as the maximum value of the anticipated deviation (amount or error) for the two light beams.

Therefore, according to this first embodiment, the light beam scanning unit 2 simultaneously forms the first and second patterns 5*a* and 5*b* of the image pattern 5 on the photoconductive body 1 or, the first and second patterns 50*a* and 50*b* of the image pattern 50 on the photoconductive body 1, from which the image tone difference is easily detectable. For this reason, when forming the toner image by simultaneously scanning the photoconductive body 1 by the plurality of light beams, it is possible to easily and positively correct the error in the plurality of light beams in the main scan direction. Consequently, the image forming apparatus 0 can form an image having a high picture quality at a low cost.

Figure 10:
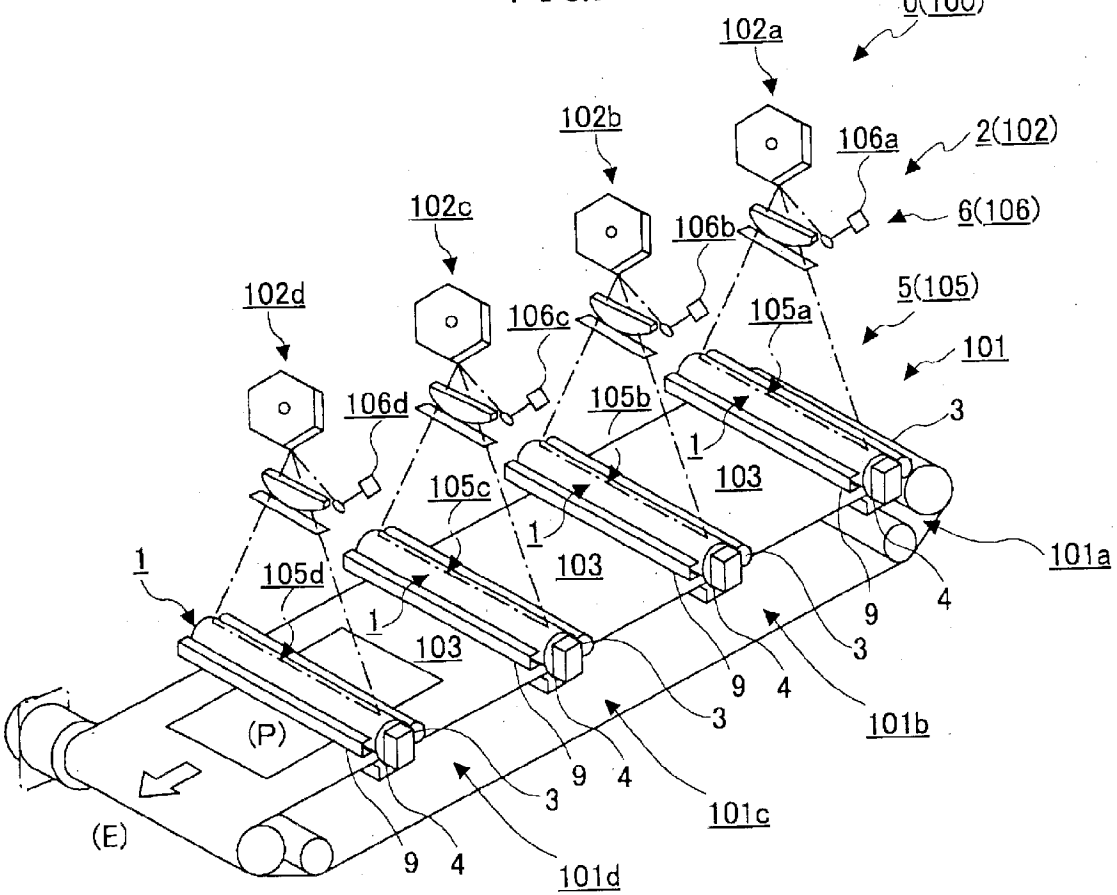
FIG. 10 is a perspective view showing a second embodiment of the image forming apparatus according to the present invention.

FIG. 10 is a perspective view showing a second embodiment of the image forming apparatus according to the present invention. In FIG. 10, those parts which are the same as those corresponding parts in FIGS. 1 and 2 are designated by the same reference numerals, and a description thereof will be omitted. In this second embodiment of the image forming apparatus, the present invention is applied to a color printer. A color image forming apparatus 100 forms a color image by overlapping yellow, magenta, cyan and black toner images in a color image forming section 101.

The color image forming section 101 includes a yellow image forming unit 101*a* for forming the yellow toner image, a magenta image forming unit 101*b* for forming the magenta toner image, a cyan image forming unit 101*c* for forming the cyan toner image, and a black image forming unit 101*d* for forming the black toner image. Each of the image forming units 101*a* through 101*d* includes the photoconductive body 1, the developing unit 3, the charging unit 9, the transfer unit 4 and the like. A light beam scanning section 102 includes a light beam scanning unit 102*a* for scanning the photoconductive body 1 of the yellow image forming unit 101*a*, a light beam scanning unit 102*b* for scanning the photoconductive body 1 of the magenta image forming unit 101*b*, a light beam scanning unit 102*c* for scanning the photoconductive body 1 of the cyan image forming unit 101*c*, and a light beam scanning unit 102*d* for scanning the photoconductive body 1 of the black image forming unit 101*d*. Each of the light beam scanning units 102*a* through 102*d* has a structure similar to that of the light beam scanning unit 2 of the first embodiment, and emits light beams for forming an electrostatic latent image on the surface of the corresponding photoconductive body 1.

A transport belt 103 transports the recording medium (P) in a direction indicated by an arrow (E) in FIG. 10. As the recording medium (P) is transported in the direction (E) by the transport belt 103, the yellow toner image, the magenta toner image, the cyan toner image and the black toner image are successively formed on the recording medium (P) in an overlapping manner by the image forming units 101*a*, 101*b*, 101*c* and 101*d*. As a result, a color toner image is formed on the recording medium (P) by the overlapping yellow, magenta, cyan and black toner images.

A color pattern 105 is formed. The color pattern 105 is formed by a plurality of yellow patterns 105*a*, a plurality of magenta patterns 105*b*, a plurality of cyan patterns 105*c*, and a plurality of black patterns 105*d* which are formed by the corresponding image forming units 101*a*, 101*b*, 101*c* and 101*d*. The patterns 105*a* through 105*d* respectively are similar to the image pattern 5 of the first embodiment. A color ON start timing adjusting section 106 includes a yellow ON start timing adjuster 106*a*, a magenta ON start timing adjuster 106*b*, a cyan ON start timing adjuster 106*c* and a black ON start timing adjuster 106*d*. Each of the ON start timing adjusters 106*a* through 106*d* has a structure similar to that of the ON start timing adjuster 6 of the first embodiment. Hence, the ON start timing of one of the plurality of light beams emitted from each of the light beam scanning units 102*a* through 102*d* is adjusted by the corresponding ON start timing adjusters 106*a* through 106*d*, using the image tones of the corresponding patterns 105*a* through 105*d*, similarly to the first embodiment.

Therefore, according to this second embodiment, when forming the toner image by simultaneously scanning the photoconductive body 1 by the plurality of light beams in each of the image forming units 101*a* through 101*d*, it is possible to easily and positively correct the error in the plurality of light beams in the main scan direction, for each of the light beam scanning units 102*a* through 102*d*. Consequently, the image forming apparatus 100 can form a color image having a high picture quality at a low cost.

Figure 11:
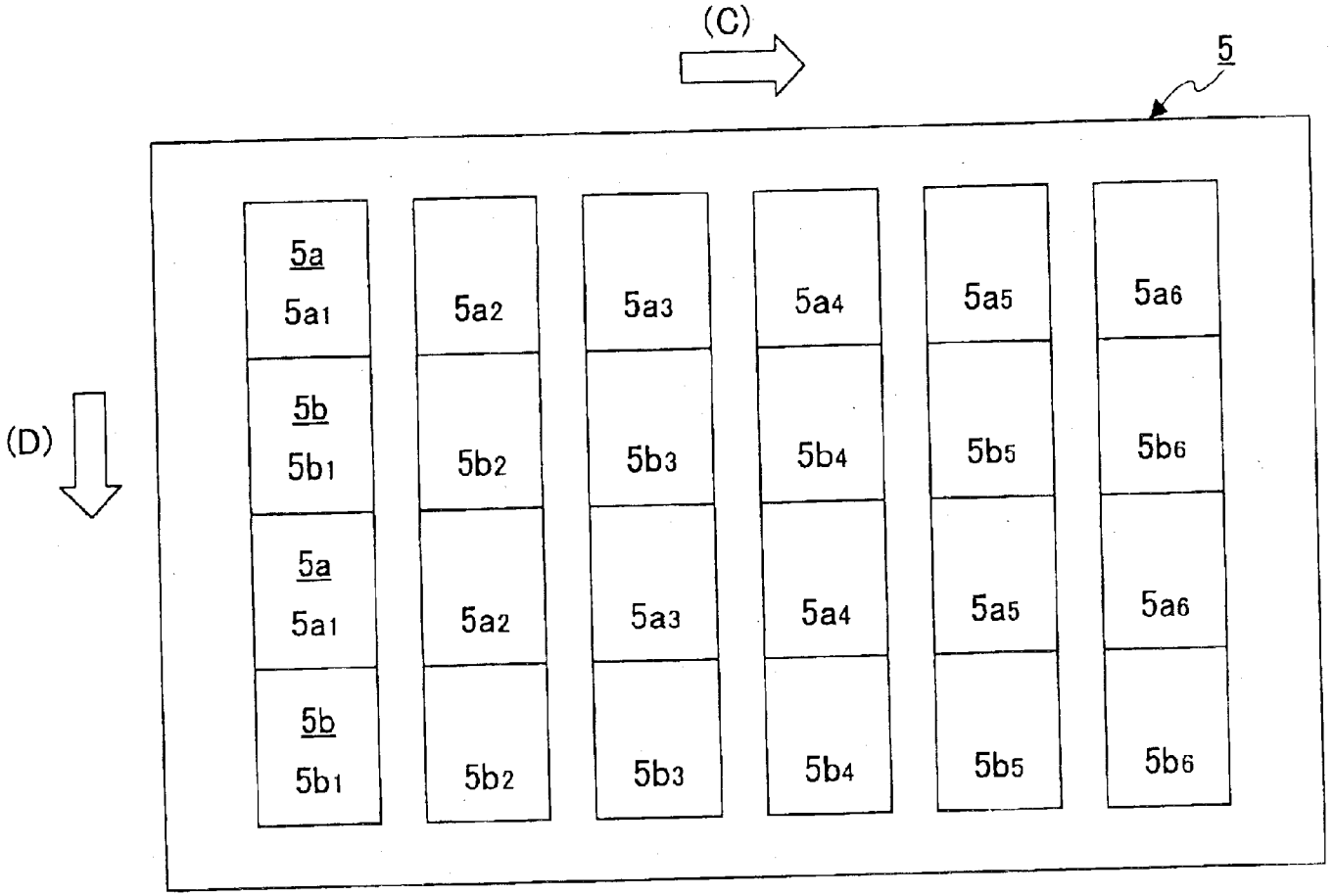
FIG. 11 is a diagram for explaining an image pattern used in the second embodiment of the image forming apparatus.

FIG. 11 is a diagram for explaining image pattern used in the second embodiment of the image forming apparatus. The image pattern 5 shown in FIG. 11 includes n kinds of first patterns 5*a* and n kinds of second patterns 5*b* arranged in the main scan direction (C). The first patterns 5*a* and the second patterns 5*b* are alternately arranged in the sub scan direction (D). The n kinds of first patterns 5*a* include patterns 5*a*1 through 5*a*n, and the n kinds of second patterns 5*b* include patterns 5*b*1 through 5*bn*.

In this embodiment, n=6. Hence, the n kinds of first patterns 5*a* include patterns 5*a*1 through 5*a*6, and the n kinds of second patterns 5*b* include patterns 5*b*1 through 5*b*6. The timing of the synchronizing signal /DETP1 for the laser diode 2*a*1 of the laser diode unit 2*a* or, the timing of the synchronizing signal /DETP2 for the laser diode 2*a*2 of the laser diode unit 2*a*, differ for each of the patterns 5*a*1 through 5*a*6 of the first patterns 5*a* and each of the patterns 5*b*1 through 5*b*6 of the second patterns, in each of the light beam scanning units 102*a* through 102*d*.

Of the patterns 5*a*1 through 5*a*6 of the first patterns 5*a* and the patterns 5*b*1 through 5*b*6 of the second patterns 5*b*, the pattern having a smallest image tone difference is selected. The ON start timing adjuster 6 adjusts the ON start timing based on the selected pattern, and thus, the ON start timing can easily be set by a simple operation.

The alternatives increase and the deterioration of the picture quality can be suppressed more if the number of kinds (n) of the plurality of first patterns 5*a* and the plurality of second patterns 5*b* is larger. Hence, it is preferable to determine the number of kinds (n) of the plurality of first patterns 5*a* and the plurality of second patterns 5*b* based on the tolerable image tone difference and the deviation (amount of error) of the two light beams in each of the light beam scanning units 102*a* through 102*d* for the tolerable image tone difference as well as the maximum value of the anticipated deviation (amount or error) for the two light beams in each of the light beam scanning units 102*a* through 102*d*.

Therefore, according to this second embodiment, each of the light beam scanning units 102*a* through 102*d* simultaneously forms the first and second patterns 5*a* and 5*b* of the image pattern 5 on the photoconductive body 1 of the corresponding one of the image forming units 101*a* through 101*d*, from which the image tone difference is easily detectable. For this reason, when forming the toner image of each color by simultaneously scanning the photoconductive body 1 of each of the image forming units 101*a* through 101*d* by the plurality of light beams from the corresponding one of the light beam scanning units 102*a* through 102*d*, it is possible to easily and positively correct the error in the plurality of light beams in the main scan direction. Consequently, the image forming apparatus 100 can form a color image having a high picture quality at a low cost.

FIG. 12 is a system block diagram showing a third embodiment of the image forming apparatus. In this third embodiment of the image forming apparatus, the present invention may be applied to a monochrome printer or a color printer. In FIG. 12, those parts which are the same as those corresponding parts in FIGS. 4 and 10 are designated by the same reference numerals, and a description thereof will be omitted. FIG. 12 shows the structure for only one light beam scanning unit 2, but this structure may be used with respect to each of the light beam scanning units 102*a* through 102*d* of the light beam scanning section 102 in the case of a color printer.

In FIG. 12, an external input section 7, having an operation panel 7*a*, is connected to the ON start timing adjuster 6. Instructions and/or information is input from the operation panel 7*a* to adjust the ON start timing adjuster 6, so that the plurality of first patterns 5*a* and the plurality of second patterns 5*b* of a desired image pattern 5 are output, and an image tone difference of the first patterns 5*a* and the second patterns 5*b* on the photoconductive body 1 is set to a tolerable value. In other words, the ON start timing of the synchronizing signal /DETP1 for the laser diode 2*a*1 and/or the synchronizing signal /DETP2 for the laser diode 2*a*2 may be changed from the operation panel 7*a* with respect to the light beam scanning unit 2.

The alternatives may be determined in advance from the tolerable image tone difference and the deviation (amount of error) of the two light beams in the light beam scanning unit 2 for the tolerable image tone difference as well as the maximum value of the anticipated deviation (amount or error) for the two light beams in the light beam scanning unit 2. The change in the ON start timing of the synchronizing signal /DETP1 and/or the synchronizing signal /DETP2 may be selected from such alternatives and instructed from the operation panel 7*a*.

Therefore, the forming of the patterns 5*a*1 through 5*an* of the first plurality of patterns 5*a* and the patterns 5*b*1 through 5*b*n of the second plurality of patterns 5*b* by the light beam scanning unit 2 may be instructed from the operation panel 7*a* of the external input section 7, and the patterns with the smallest image tone difference may be selected. The setting of the ON start timing by the ON start timing adjuster 6 may easily be made by a simple operation from the operation pane 7*a*, based on the selected patterns with the smallest image tone difference.

Accordingly, according to this third embodiment, the light beam scanning unit 2 simultaneously forms the first and second patterns 5*a* and 5*b* of the image pattern 5 on the photoconductive body 1, from which the image tone difference is easily detectable. For this reason, when forming the toner image by simultaneously scanning the photoconductive body 1 by the plurality of light beams from the light beam scanning unit 2, it is possible to easily and positively correct the error in the plurality of light beams in the main scan direction also in response to an operation made by the user at an arbitrary time from the operation panel 7*a*. Consequently, the image forming apparatus 0 or 100 can form an image having a high picture quality at a low cost.

Figure 13:
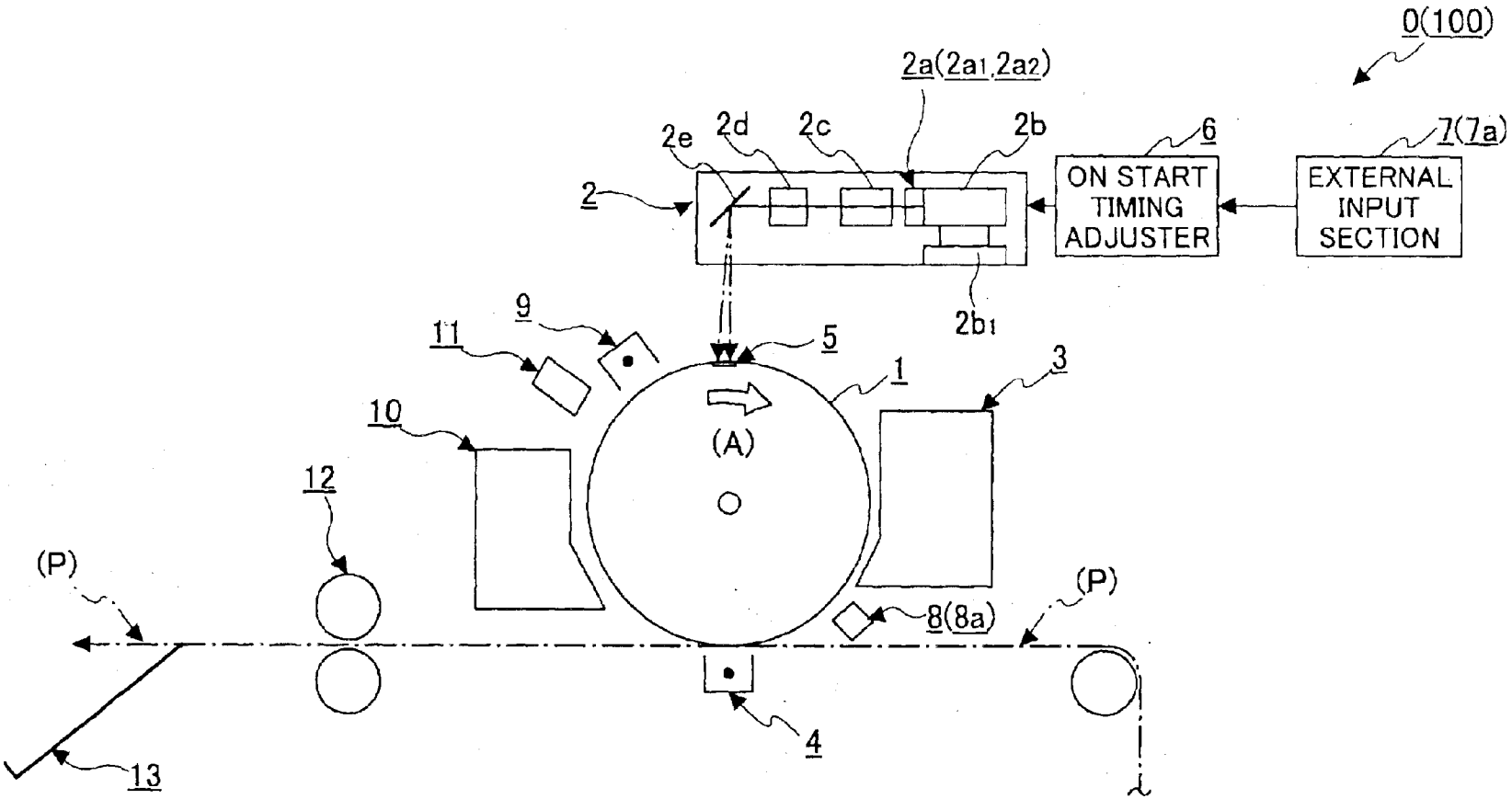
FIG. 13 is a system block diagram showing a fourth embodiment of the image forming apparatus.

FIG. 13 is a system block diagram showing a fourth embodiment of the image forming apparatus, and FIG. 14 is a system block diagram showing an important part of the fourth embodiment of the image forming apparatus. In this fourth embodiment of the image forming apparatus, the present invention may be applied to a monochrome printer or a color printer. In FIGS. 13 and 14, those parts which are the same as those corresponding parts in FIGS. 1, 4 and 12 are designated by the same reference numerals, and a description thereof will be omitted.

A pattern image tone detecting unit 8 shown in FIGS. 13 and 14, including a toner image tone detector 8*a*, is connected to the printer controller 16 as shown in FIG. 14. The toner image tone detector 8*a* detects the image tone of the toner image of the plurality of patterns of the image pattern 5 formed on the photoconductive body 1. The ON start timing of the ON start timing adjuster 6 is adjusted based on an image tone detection signal output from the toner image tone detector 8*a*. More particularly, the image tone detection signal from the toner image tone detector 8*a* is supplied to the printer controller 16, and the ON start timing of the ON start timing adjuster 6 is controlled by the printer controller 16.

Figure 15:
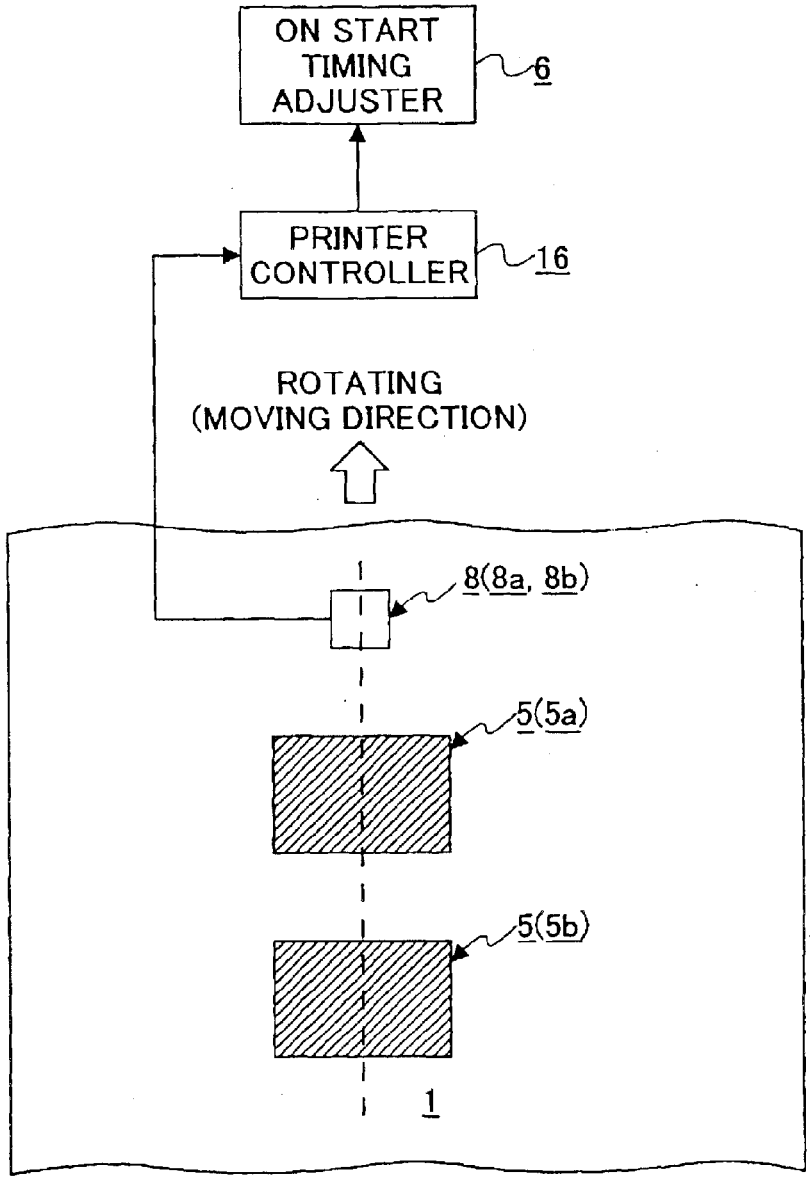
FIG. 15 is a diagram for explaining the operation of an important part of the fourth embodiment of the image forming apparatus.

In other words, when the toner images of the plurality of first patterns 5*a* and the plurality of second patterns 5*b* of the image pattern 5 are formed on the photoconductive body 1, the toner image tone detector 8*a* automatically detects the image tones of the toner images of the first and second patterns 5*a* and 5*b* of the image pattern 5. The image tone detection signal, indicative of the detected image tone, is output from the toner image tone detector 8*a* to the printer controller 16, as shown in FIG. 15. FIG. 15 is a diagram for explaining the operation of an important part of the fourth embodiment of the image forming apparatus. The printer controller 16 controls and adjusts the ON start timing of the ON start timing adjuster 6 as shown in FIG. 16.

Figure 16:
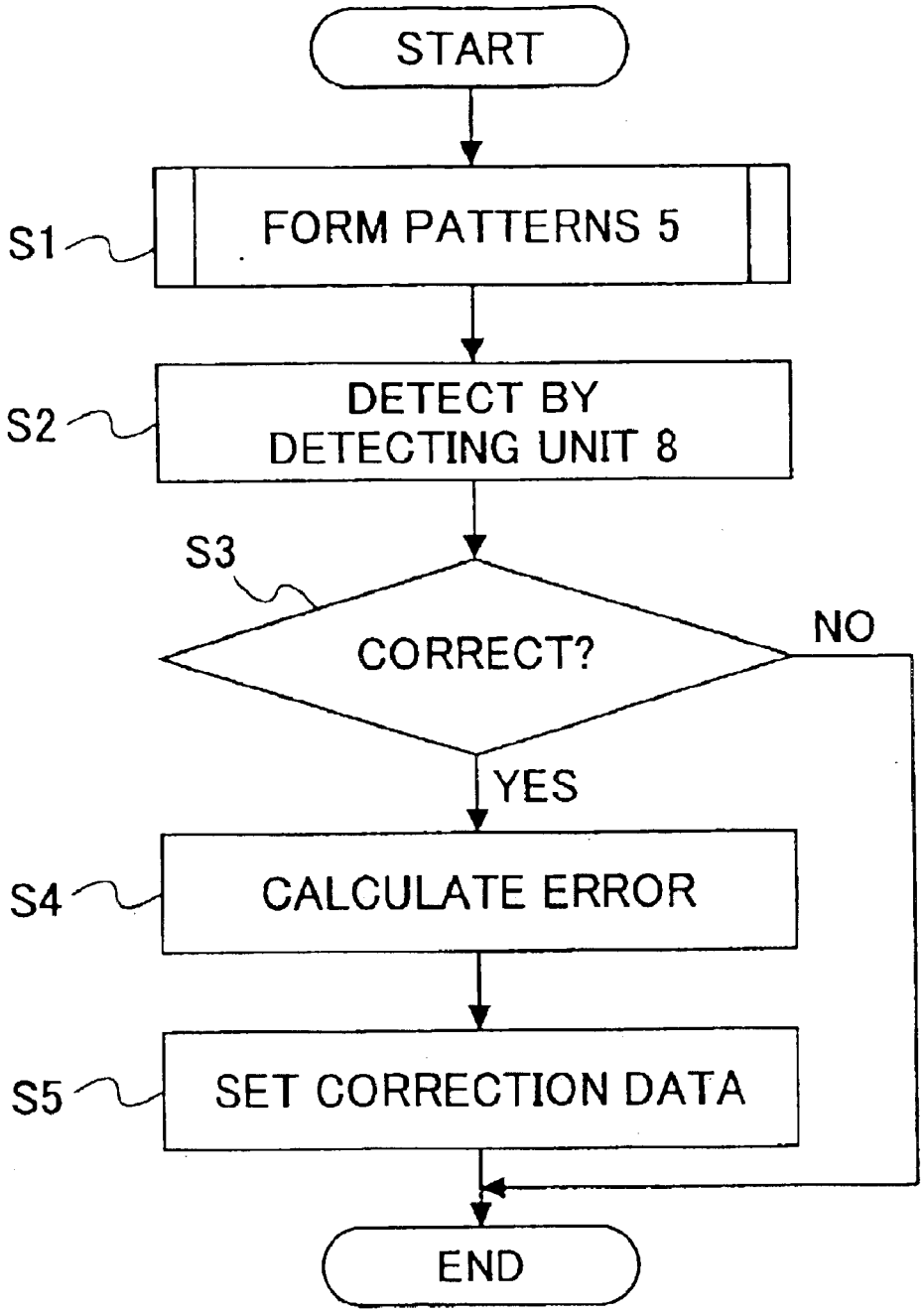
FIG. 16 is a flow chart for explaining the operation of the fourth embodiment of the image forming apparatus for adjusting an ON start timing of an ON start timing adjuster.

FIG. 16 is a flow chart for explaining the operation of the fourth embodiment of the image forming apparatus for adjusting the ON start timing of the ON start timing adjuster 6.

A step S1 shown in FIG. 16 forms the plurality of first and second patterns 5*a* and 5*b* of the image pattern 5 shown in FIG. 15 on the photoconductive body 1 in the image forming apparatus 0 or 100. A step S2 detects the image tones of the first and second patterns 5*a* and 5*b* of the image pattern 5 by the toner image tone detector 8*a* of the pattern image tone detecting unit 8.

A step S3 decides whether or not the ON start timing of the ON start timing adjuster 6 is to be corrected, based on the image tone difference of the first and second patterns 5*a* and 5*b* of the image pattern 5 detected by the toner image tone detector 8*a*. The decision in the step S3 is made based on the tolerable image tone difference and the minimum unit of ON start timing adjustment with respect to the synchronizing signal /DETP1 and/or the synchronizing signal /DETP2 which are determined in advance. If there is no image tone difference or the image tone difference is within the tolerable image tone difference, the decision result in the step S3 is NO. If the decision result in the step S3 is NO, the ON start timing adjustment is not made, and the process ends.

On the other hand, if the image tone difference exists or the image tone difference exceeds the tolerable image tone difference, the decision result in the step S3 is YES and the process advances to a step S4. The step S4 calculates a correction value for the ON start timing for correcting the deviation of the light beams, based on the image tone difference. For example, correction values may be determined in advance with respect to various image tone differences for the deviations of the light beams, and the step S4 may select the correction value with respect to the image tone difference which is closest to the detected image tone difference. After the step S4, a step S5 sets the correction value or correction data with respect to the ON start timing adjuster 6, and the process ends.

The instruction to output the plurality of first and second patterns 5*a* and 5*b* of the image pattern 5 may be input from the operation panel 7*a* of the external input section 7 at any time. Hence, it is possible to easily adjust the ON start timing of the ON start timing adjuster 6 at an arbitrary time.

Furthermore, by carrying out the process of adjusting the ON start timing of the ON start timing adjuster 6 shown in FIG. 16 at a predetermined period, it is possible to cope with changes with lapse of time (or aging). This predetermined period may be made variable from the operation panel 7*a* of the external input section 7, so as to suit a case where only negligible changes occur with lapse of time or to suit a case where notable changes occur with lapse of time. It is also possible vary the predetermined period depending on whether emphasis is to be put on the number of images formed or the picture quality of the images formed.

Of course, if a sensor (not shown) is provided for use in a process control or the like, it is possible to determine the predetermined period at which the process of adjusting the ON start timing of the ON start timing adjuster 6 is to be carried out based on an output of this sensor.

Accordingly, according to this fourth embodiment, the light beam scanning unit 2 simultaneously forms the first and second patterns 5*a* and 5*b* of the image pattern 5 on the photoconductive body 1, from which the image tone difference is easily detectable. For this reason, when forming the toner image by simultaneously scanning the photoconductive body 1 by the plurality of light beams from the light beam scanning unit 2, it is possible to easily and positively correct the error in the plurality of light beams in the main scan direction, automatically, at a predetermined period which may be variable from the operation panel 7*a*. Consequently, the image forming apparatus 0 or 100 can form an image having a high picture quality at a low cost.

Figure 17:
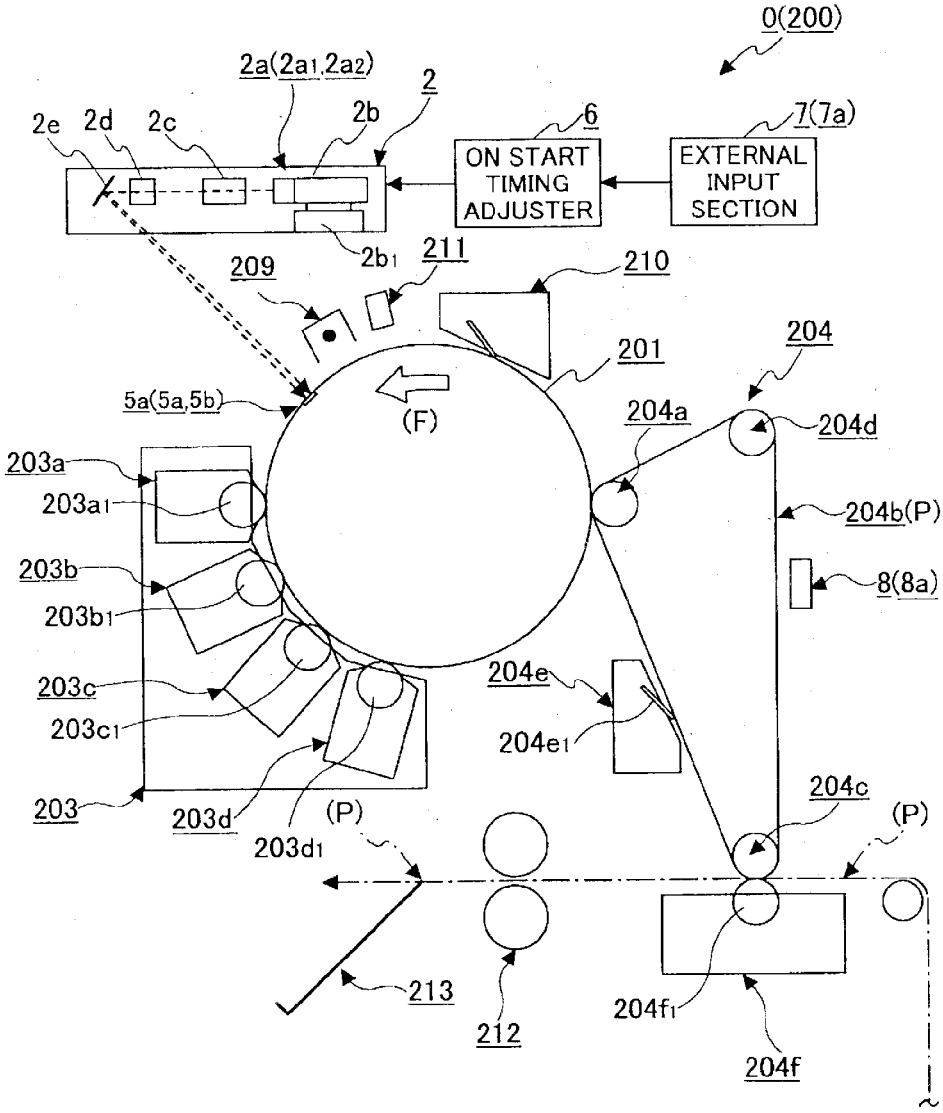
FIG. 17 is a diagram showing a fifth embodiment of the image forming apparatus according to the present invention.

FIG. 17 is a diagram showing a fifth embodiment of the image forming apparatus according to the present invention. In this fifth embodiment of the image forming apparatus, the present invention is applied to a color printer. In FIG. 17, those parts which are the same as those corresponding parts in FIG. 13 are designated by the same reference numerals, and a description thereof will be omitted.

In a color image forming apparatus 200 shown in FIG. 17, a photoconductive body 201 has a drum shape, and rotates in a direction of an arrow (F). The light beam scanning unit 2 simultaneously scans the surface of the photoconductive body 201 by a plurality of light beams, so as to form an electrostatic latent image on the photoconductive body 201. A developing section 203 supplies a toner to the photoconductive body 201 and forms a toner image on the photoconductive body 201. A transfer section 204 transfers the toner transfers the toner image formed on the photoconductive body 201 onto the recording medium (P).

The plurality of first patterns 5*a* and the plurality of second patterns 5*b* of the image pattern are formed by the light beam scanning unit 2, and the ON start timing of at least one of the light beams is adjusted by the ON start timing adjuster 6 based on the image tones of the plurality of patterns of the image pattern 5. For this reason, when forming the toner image by simultaneously scanning the photoconductive body 1 by the plurality of light beams from the light beam scanning unit 2, it is possible to easily and positively correct the error in the plurality of light beams in the main scan direction. Consequently, the image forming apparatus 0 or 100 can form a color image having a high picture quality at a low cost.

In the light beam scanning unit 2, laser diodes 2*a*1 and 2*a*2 of the laser diode unit 2*a* are turned ON depending on image data. The light beams from the laser diodes 2*a*1 and 2*a*2 are formed into parallel rays by a collimator lens (not shown), and are deflected by the polygon mirror 2*b* via a cylindrical lens (not shown). The polygon mirror 2*b* is rotated by the polygon motor 2*b*1. The deflected light beams from the polygon mirror 2*b* pass through the fθ lens 2*c* and the barrel toroidal lens 2*d*, and are reflected by the mirror 2*e* to scan the photoconductive body 1. As a result, data are optically written on the photoconductive body 1 depending on the image data, to thereby form the electrostatic latent image on the surface of the photoconductive body 1.

A cleaning unit 210, a discharge unit 211, a charging unit 209, the developing section 203, and the transfer section 204 are arranged around the photoconductive body 201. The developing section 204 includes a black developing unit

203*a*, a cyan developing unit 203*b*, a magenta developing unit 203*c* and a yellow developing unit 203*d*. The transfer section 204 includes an intermediate transfer belt (transfer member) 204*b* and the like.

The black developing unit 203*a* includes a black developing sleeve 203*a*1 which rotates to make a developing agent (developer) which is used for developing the electrostatic latent image confront the surface of the photoconductive body 1, and a developing paddle which rotates to agitate the developing agent. Similarly, the cyan developing unit 203*b* includes a cyan developing sleeve 203*b*1 which rotates to make the developing agent confront the surface of the photoconductive body 1, and a developing paddle which rotates to agitate the developing agent. The magenta developing unit 203*c* includes a magenta developing sleeve 203*c*1 which rotates to make the developing agent confront the surface of the photoconductive body 1, and a developing paddle which rotates to agitate the developing agent. The yellow developing unit 203*d* includes a cyan developing sleeve 203*d*1 which rotates to make the developing agent confront the surface of the photoconductive body 1, and a developing paddle which rotates to agitate the developing agent.

Of course, the order in which the black, cyan, magenta and yellow developing units 203*a*, 203*b*, 203*c* and 203*d* are arranged around the photoconductive body 1 is not limited to that shown in FIG. 17. In addition, the order in which the black, cyan, magenta and yellow developing units 203*a*, 203*b*, 203*c* and 203*d* are used is also not limited to this order of arrangement.

When the print operation is started, the electrostatic latent image is formed on the photoconductive body 1 by the light beams from the laser diodes 2*a*1 and 2*a*2 of the laser diode unit 2*a* within the light beam scanning unit 2, based on black image data. In order to enable black development from a leading end portion of the electrostatic latent image, the black developing sleeve 203*a*1 starts to rotate before the leading end portion of the electrostatic latent image reaches a black developing position of the black developing unit 203*a*. The developing of the black region of the electrostatic latent image is continued, and the black developing unit 203*a* is made inactive when a trailing end portion of the electrostatic latent image passes the black developing position. The print operation for the black image data is completed at least before the leading end portion of the electrostatic latent image reaches a cyan developing position of the cyan developing unit 203*b* after making approximately one revolution in the direction (F).

The black toner image formed on the photoconductive body 1 is transferred onto a surface of the intermediate transfer belt 204*b* which moves at the same speed as the photoconductive body 1. The surface of the intermediate transfer belt 204*b* is in contact with the surface of the photoconductive body 1, and the black toner image is transferred onto the surface of the intermediate transfer belt 204*b* by applying a predetermined bias voltage to a belt transfer bias roller 204*a*.

The transfer section 204 includes the belt transfer bias roller 204*a*, the intermediate transfer belt 204*b*, a driving roller 204*c*, and a roller 204*d*. The intermediate transfer belt 204*b* is provided around the rollers 204*a*, 204*b* and 204*c*, and is driven by the driving roller 204*c* which is rotated by a driving motor (not shown).

Cyan, magenta and yellow toner images are successively formed by the cyan, magenta and yellow developing units 203*b*, 203*c* and 203*d* on the black toner image in an overlapping manner on the photoconductive body 1, and are successively transferred onto the intermediate transfer belt 204*b* in alignment with the black toner image, so as to form a color toner image on the intermediate transfer belt 204*b*. This color toner image is thereafter transferred onto the recording medium (P).

The toner image tone detector 8*a* of the pattern image tone detecting unit 8 is arranged adjacent to the intermediate transfer belt 204*b*, so as to automatically detect the image tones of the color toner images of the plurality of first and second patterns 5*a* and 5*b* of the image pattern 5 transferred onto the intermediate transfer belt 204*b*. Based on the image tones of the plurality of first and second patterns 5*a* and 5*b* of the image pattern 5 detected by the toner image tone detector 8*a*, the ON start timing adjuster 6 adjusts the ON start timing of at least one of the light beams emitted from the light beam scanning unit 2.

The transfer section 204 also includes a belt cleaning unit 204*e*, and a paper transfer unit 204*f*. The belt cleaning unit 204*e* includes a blade 204*e*1, a moving mechanism (not shown) for moving the blade 204*e*1 between a contact position where the blade 204*e*1 is in contact with the surface of the intermediate transfer belt 204*b* and a separated position where the blade 204*e*1 is separated from the surface of the intermediate transfer belt 204*b*. When transferring the black, cyan, magenta or yellow toner image onto the intermediate transfer belt 204*b*, the blade 204*e*1 is at the separated position. The blade 204*e*1 is moved to the contact position when cleaning the surface of the intermediate transfer belt 204*b* after the color image is transferred onto the recording medium (P).

The paper transfer unit 204*f* includes a paper transfer bias roller 204*f*1, a moving mechanism (not shown) for moving the paper transfer bias roller 204*f*1 between a contact position where the paper transfer bias roller 204*f*1 is in contact with the intermediate transfer belt 204*b*, and a separated position where the paper transfer bias roller 204*f*1 is separated from the intermediate transfer belt 204*b*. Normally, the paper transfer bias roller 204*f*1 is at the separated position. However, when transferring the color toner image onto the recording medium (P) in one operation, the paper transfer bias roller 204*f*1 is moved to the contact position, so as to apply a predetermined bias voltage on the intermediate transfer belt 204*b*.

The recording medium (P) is supplied by a known paper supply mechanism (not shown) in synchronism with a timing at which the leading end portion of the color toner image on the intermediate transfer belt 204*b* reaches a paper transfer position. The color toner image transferred onto the recording medium (P) is fixed by a fixing unit 212 and is ejected onto a paper eject tray 213 by a known mechanism (not shown).

A detailed description of the ON start timing adjuster 6 which adjusts the ON start timing of at least one of the light beams emitted from the light beam scanning unit 2, based on the image tones of the plurality of first and second patterns 5*a* and 5*b* of the image pattern 5 detected by the toner image tone detector 8*a*, will be omitted because the adjustment is basically the same as that described above. In this embodiment, the same light beam scanning unit 2 is used in common for all of the four colors, namely, black, cyan, magenta and yellow. Hence, the plurality of first and second patterns 5*a* and 5*b* of the image pattern 5 are formed in one of the four colors, and the ON start timing of the ON start timing adjuster 6 is adjusted based on the image tones detected by the toner image tone detector 8*a*, for each of the four colors. Since the image tone difference is more difficult to detect in the case of the yellow toner image, it is preferable to form the plurality of first and second patterns 5*a* and 5*b* of the image pattern 5 in one suitable color other than yellow, depending on the sensitivity or the like of the toner image tone detector 8*a* used.

Of course, the output of the plurality of first and second patterns 5*a* and 5*b* of the image pattern 5 may be instructed at an arbitrary time from the operation panel 7*a* of the external input section 7. In other words, the ON start timing of the light beams may be adjusted by the ON start timing adjuster 6 at an arbitrary time.

Furthermore, by carrying out the process of adjusting the ON start timing of the ON start timing adjuster 6 at a predetermined period, it is possible to cope with changes with lapse of time. This predetermined period may be made variable from the operation panel 7*a* of the external input section 7, so as to suit a case where only negligible changes occur with lapse of time or to suit a case where notable changes occur with lapse of time. It is also possible vary the predetermined period depending on whether emphasis is to be put on the number of images formed or the picture quality of the images formed.

Of course, if a sensor (not shown) is provided for use in a process control or the like, it is possible to determine the predetermined period at which the process of adjusting the ON start timing of the ON start timing adjuster 6 is to be carried out based on an output of this sensor.

Accordingly, according to this fifth embodiment, the light beam scanning unit 2 simultaneously forms the first and second patterns 5*a* and 5*b* of the image pattern 5 on the intermediate transfer belt 204*b* of the transfer section 204, from which the image tone difference is easily detectable. For this reason, when forming the color toner image by simultaneously scanning the photoconductive body 1 by the plurality of light beams from the light beam scanning unit 2 and successively transferring the toner images of the four colors in an overlapping manner onto the intermediate transfer belt 204*b*, it is possible to easily and positively correct the error in the plurality of light beams in the main scan direction for each of the four colors, automatically, at a predetermined period which may be variable from the operation panel 7*a*. Consequently, the color image forming apparatus 200 can form a color image having a high picture quality at a low cost.

Figure 18:
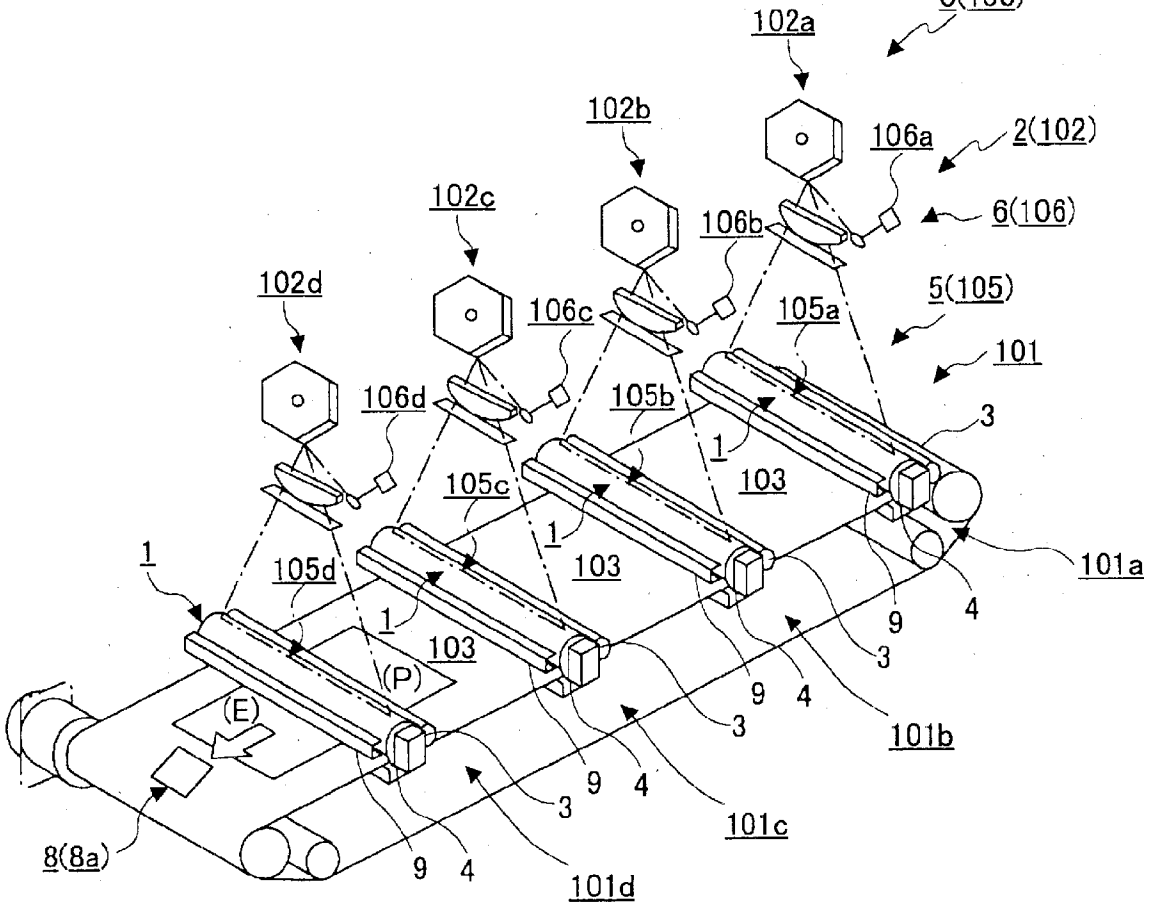
FIG. 18 is a perspective view showing a sixth embodiment of the image forming apparatus according to the present invention.

FIG. 18 is a perspective view showing a sixth embodiment of the image forming apparatus according to the present invention. In this sixth embodiment of the image forming apparatus, the present invention is applied to a color printer. In FIG. 18, those parts which are the same as those corresponding parts in FIG. 10 are designated by the same reference numerals, and a description thereof will be omitted. A color image forming apparatus 100 shown in FIG. 18 forms a color image by overlapping yellow, magenta, cyan and black toner images in a color image forming section 101.

The color image forming section 101 includes a yellow image forming unit 101*a* for forming the yellow toner image, a magenta image forming unit 101*b* for forming the magenta toner image, a cyan image forming unit 101*c* for forming the cyan toner image, and a black image forming unit 101*d* for forming the black toner image. Each of the image forming units 101*a* through 101*d* includes the photoconductive body 1, the developing unit 3, the charging unit 9, the transfer unit 4 and the like. A light beam scanning section 102 includes a light beam scanning unit 102*a* for scanning the photoconductive body 1 of the yellow image forming unit 101*a*, a light beam scanning unit 102*b* for scanning the photoconductive body 1 of the magenta image forming unit 101*b*, a light beam scanning unit 102*c* for scanning the photoconductive body 1 of the cyan image forming unit 101*c*, and a light beam scanning unit 102*d* for scanning the photoconductive body 1 of the black image forming unit 101*d*. Each of the light beam scanning units 102*a* through 102*d* has a structure similar to that of the light beam scanning unit 2 of the first embodiment, and emits light beams for forming an electrostatic latent image on the surface of the corresponding photoconductive body 1.

A transport belt 103 transports the recording medium (P) in a direction indicated by an arrow (E) in FIG. 18. As the recording medium (P) is transported in the direction (E) by the transport belt 103, the yellow toner image, the magenta toner image, the cyan toner image and the black toner image are successively formed on the recording medium (P) in an overlapping manner by the image forming units 101*a*, 101*b*, 101*c* and 101*d*. As a result, a color toner image is formed on the recording medium (P) by the overlapping yellow, magenta, cyan and black toner images.

A color pattern 105 is formed. The color pattern 105 is formed by a plurality of yellow patterns 105*a*, a plurality of magenta patterns 105*b*, a plurality of cyan patterns 105*c*, and a plurality of black patterns 105*d* which are formed by the corresponding image forming units 101*a*, 101*b*, 101*c* and 101*d*. The patterns 105*a* through 105*d* respectively are similar to the image pattern 5 of the first embodiment. The image tones of the patterns 105*a* through 105*d* are detected by a toner image tone detector 8*a* of a pattern image tone detecting unit 8. A color ON start timing adjusting section 106 includes a yellow ON start timing adjuster 106*a*, a magenta ON start timing adjuster 106*b*, a cyan ON start timing adjuster 106*c* and a black ON start timing adjuster 106*d*. Each of the ON start timing adjusters 106*a* through 106*d* has a structure similar to that of the ON start timing adjuster 6 of the first embodiment. Hence, the ON start timing of at least one of the plurality of light beams emitted from each of the light beam scanning units 102*a* through 102*d* is adjusted by the corresponding ON start timing adjusters 106*a* through 106*d*, using the image tones of the corresponding patterns 105*a* through 105*d* detected by the toner image tone detector 8*a*.

Of course, the output of the plurality of yellow, magenta, cyan and black patterns 105*a*, 105*b*, 105*c* and 105*d* of the color pattern 105 may be instructed at an arbitrary time from an operation panel 7*a* of an external input section 7. In other words, the ON start timing of the light beams may be adjusted by the ON start timing adjuster 6 at an arbitrary time.

Furthermore, by carrying out the process of adjusting the ON start timing of the ON start timing adjuster 6 at a predetermined period, it is possible to cope with changes with lapse of time. This predetermined period may be made variable from the operation panel 7*a* of the external input section 7, so as to suit a case where only negligible changes occur with lapse of time or to suit a case where notable changes occur with lapse of time. It is also possible vary the predetermined period depending on whether emphasis is to be put on the number of images formed or the picture quality of the images formed.

Of course, if a sensor (not shown) is provided for use in a process control or the like, it is possible to determine the predetermined period at which the process of adjusting the ON start timing of the ON start timing adjuster 6 is to be carried out based on an output of this sensor.

Therefore, according to this sixth embodiment, when forming the toner image by simultaneously scanning the photoconductive body 1 by the plurality of light beams in each of the image forming units 101*a* through 101*d*, it is possible to easily and positively correct the error in the plurality of light beams in the main scan direction, for each of the light beam scanning units 102*a* through 102*d*. Consequently, the image forming apparatus 100 can form a color image having a high picture quality at a low cost.

Figure 19:
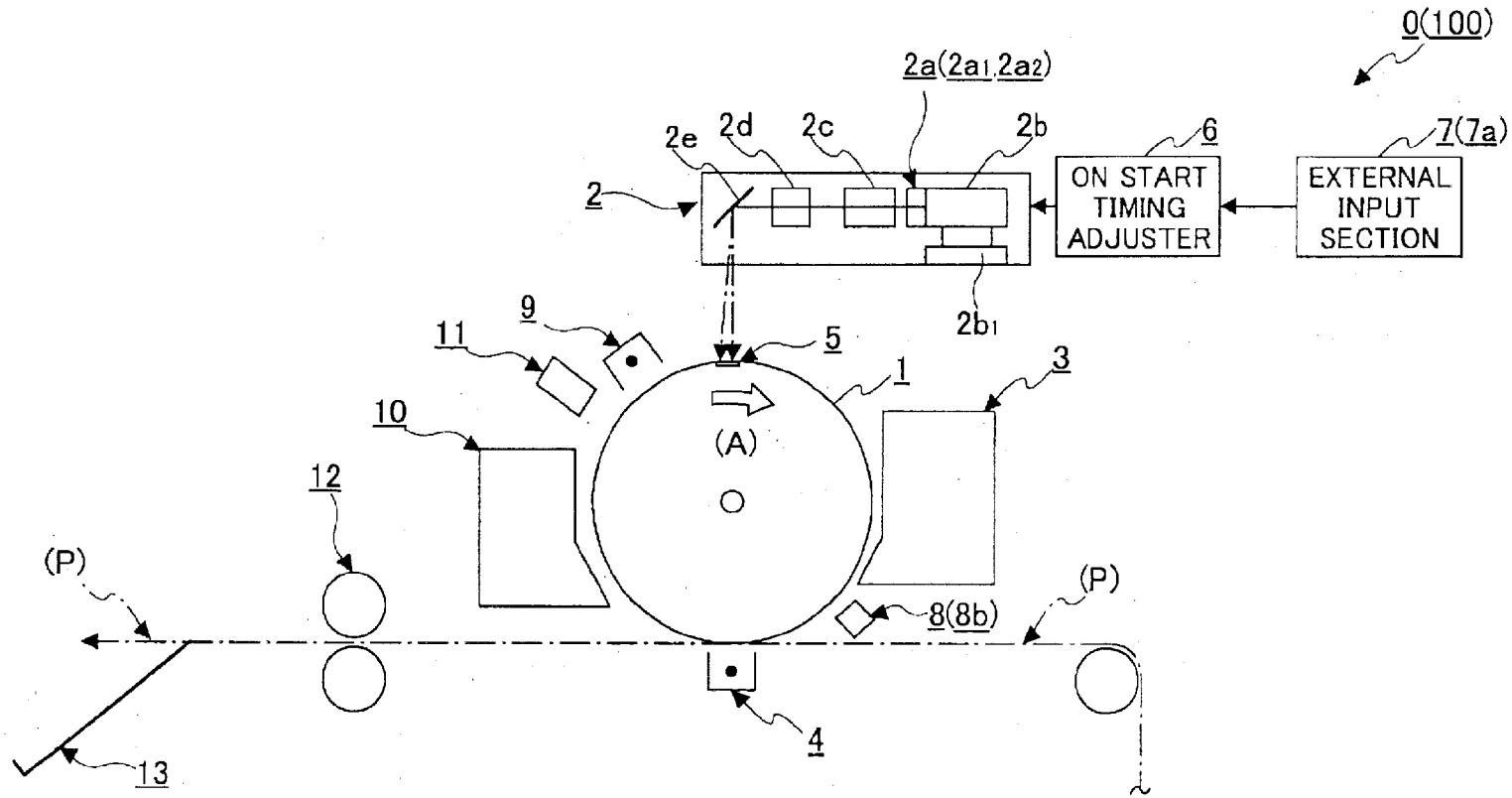
FIG. 19 is a diagram showing a seventh embodiment of the image forming apparatus according to the present invention.

FIG. 19 is a diagram showing a seventh embodiment of the image forming apparatus according to the present invention. In this seventh embodiment of the image forming apparatus, the present invention may be applied to a monochrome printer or a color printer. In FIG. 19, those parts which are the same as those corresponding parts in FIG. 13 are designated by the same reference numerals, and a description thereof will be omitted. In an image forming apparatus 0 or 100 shown in FIG. 19, a pattern image tone detecting unit 8 includes a latent image potential detector 8*b*.

The latent image potential detector 8*b* detects a latent image potential of the image pattern 5 formed on the photoconductive body 11. The ON start timing of the ON start timing adjuster 6 is adjusted based on a potential detection signal output from the latent image potential detector 8*b*. More particularly, the potential detection signal from the latent image potential detector 8*b* is supplied to the printer controller 16, and the ON start timing of the ON start timing adjuster 6 is controlled by the printer controller 16, similarly as described above for the fourth embodiment in conjunction with FIG. 14.

In other words, when the toner images of the plurality of first patterns 5*a* and the plurality of second patterns 5*b* of the image pattern 5 are formed on the photoconductive body 1, the latent image potential detector 8*b* automatically detects the latent image potentials of the toner images of the first and second patterns 5*a* and 5*b* of the image pattern 5. The potential detection signal, indicative of the detected latent image potential, is output from the latent image potential detector 8*b* to the printer controller 16, as described above for the fourth embodiment in conjunction with FIG. 15.

The printer controller 16 controls and adjusts the ON start timing of the ON start timing adjuster 6 as similarly as described above for the fourth embodiment in conjunction with FIG. 16.

In the case of this seventh embodiment, a step corresponding to the step S1 shown in FIG. 16 forms the plurality of first and second patterns 5*a* and 5*b* of the image pattern 5 shown in FIG. 15 on the photoconductive body 1 in the image forming apparatus 0 or 100. A step corresponding to the step S2 detects the latent image potentials of the first and second patterns 5*a* and 5*b* of the image pattern 5, in place of the image tones, by the latent image potential detector 8*b* of the pattern image tone detecting unit 8. A step corresponding to the step S3 decides whether or not the ON start timing of the ON start timing adjuster 6 is to be corrected, based on the latent image potential difference of the first and second patterns 5*a* and 5*b* of the image pattern 5 detected by the latent image potential detector 8*b*. The decision in the step corresponding to the step S3 is made based on the tolerable latent image potential difference and the minimum unit of ON start timing adjustment with respect to the synchronizing signal /DETP1 and/or the synchronizing signal /DETP2 which are determined in advance. If there is no latent image potential difference or the latent image potential difference is within the tolerable latent image potential difference, the decision result in the step corresponding to the step S3 is NO. If the decision result in the step corresponding to the step S3 is NO, the ON start timing adjustment is not made, and the process ends.

On the other hand, if the latent image potential difference exists or the latent image potential difference exceeds the tolerable latent image potential difference, the decision result in the step corresponding to the step S3 is YES and the process advances to a corresponding to the step S4. The step corresponding to the step S4 calculates a correction value for the ON start timing for correcting the deviation of the light beams, based on the latent image potential difference. For example, correction values may be determined in advance with respect to various latent image potential differences for the deviations of the light beams, and the step corresponding to the step S4 may select the correction value with respect to the latent image potential difference which is closest to the detected latent image potential difference. After the step corresponding to the step S4, a step corresponding to the step S5 sets the correction value or correction data with respect to the ON start timing adjuster 6, and the process ends.

The instruction to output the plurality of first and second patterns 5*a* and 5*b* of the image pattern 5 may be input from the operation panel 7*a* of the external input section 7 at any time. Hence, it is possible to easily adjust the ON start timing of the ON start timing adjuster 6 at an arbitrary time, similarly as described above for the fourth embodiment in conjunction with FIG. 14.

Furthermore, by carrying out the process of adjusting the ON start timing of the ON start timing adjuster 6 shown in FIG. 19 at a predetermined period, it is possible to cope with changes with lapse of time. This predetermined period may be made variable from the operation panel 7*a* of the external input section 7, so as to suit a case where only negligible changes occur with lapse of time or to suit a case where notable changes occur with lapse of time. It is also possible vary the predetermined period depending on whether emphasis is to be put on the number of images formed or the picture quality of the images formed.

Of course, if a sensor (not shown) is provided for use in a process control or the like, it is possible to determine the predetermined period at which the process of adjusting the ON start timing of the ON start timing adjuster 6 is to be carried out based on an output of this sensor.

Accordingly, according to this seventh embodiment, the light beam scanning unit 2 simultaneously forms the first and second patterns 5*a* and 5*b* of the image pattern 5 on the photoconductive body 1, from which the latent image potential difference is easily detectable. For this reason, when forming the toner image by simultaneously scanning the photoconductive body 1 by the plurality of light beams from the light beam scanning unit 2, it is possible to easily and positively correct the error in the plurality of light beams in the main scan direction, automatically, at a predetermined period which may be variable from the operation panel 7*a*. Consequently, the image forming apparatus 0 or 100 can form an image having a high picture quality at a low cost.

Of course, the latent image potential detector 8*b* may be used in any of the embodiments described above, so as to obtain effects similar to those obtainable in the seventh embodiment.

Moreover, the number of light beams used to form the electrostatic latent image on the image bearing member, that is, the photoconductive body, is of course not limited to two, and it is possible to use three or more light beams for the optical writing operation.

Further, the present invention is not limited to these embodiments, but various variations and modifications may be made without departing from the scope of the present invention.

What is claimed is:

1. An image forming apparatus comprising:

an image bearing member, which is rotatably supported, to bear a toner image;

a light beam scanning section to simultaneously scan the image bearing member by a plurality of light beams so as to form an electrostatic latent image on the image bearing member;

a developing section to develop the electrostatic latent image into the toner image by supplying a toner to the image bearing member;

a transfer section to transfer the toner image on the image bearing member onto a recording medium; and an ON start timing adjuster to adjust an ON start timing of one of the plurality of light beams, based on an image tone of each of a plurality of patterns of an image pattern formed by the light beam scanning section.

2. The image forming apparatus as claimed in claim 1, wherein:

the image pattern includes first patterns and second patterns, the first patterns being formed by shifting a first light beam in a main scan direction by one dot with respect to a second light beam and repeating an image pattern formed thereby in a sub scan direction, and further repeating an image pattern formed thereby in the main scan direction at intervals of n dots, the second patterns being formed by shifting the first light beam in a direction opposite to the main scan direction by one dot with respect to the second light beam and repeating an image pattern formed thereby in the sub scan direction, and further repeating an image pattern formed thereby in the main scan direction at intervals of n dots, where the main and sub scan directions are approximately perpendicular to each other, and n is greater than or equal to one.

3. The image forming apparatus as claimed in claim 2, wherein the light beam scanning section simultaneously forms the first patterns and the second patterns on the image bearing member.

4. The image forming apparatus as claimed in claim 3, further comprising:

an external input section to instruct output of the first patterns and the second patterns.

5. The image forming apparatus as claimed in claim 4, wherein the external input section includes an operation panel.

6. The image forming apparatus as claimed in claim 3, wherein the ON start timing adjuster adjusts the ON start timing so that an image tone difference of the first patterns and the second patterns on the image bearing member falls within a tolerable range.

7. The image forming apparatus as claimed in claim 6, wherein the ON start timing of the ON start timing adjuster is adjustable from the external input section.

8. The image forming apparatus as claimed in claim 7, wherein the external input section includes an operation panel.

9. The image forming apparatus as claimed in claim 3, wherein the light beam scanning section simultaneously form on the image bearing member a plurality of first patterns having different ON start timings and a plurality of second patterns having different ON start timings.

10. The image forming apparatus as claimed in claim 9, wherein the ON start timing adjuster adjusts the ON start timings for the plurality of first patterns and the plurality of second patterns having tolerable image tone differences to selected ON start timings.

11. The image forming apparatus as claimed in claim 9, wherein forming of the plurality of first patterns and the plurality of second patterns is instructed from the external input section to the light beam scanning section.

12. The image forming apparatus as claimed in claim 11, wherein the external input section includes an operation panel.

13. The image forming apparatus as claimed in claim 1, further comprising:

a detecting unit to detect a toner image tone of the plurality of patterns.

14. The image forming apparatus as claimed in claim 13, wherein the ON start timing adjuster adjusts the ON start timing based on the toner image tone detected by the detecting unit.

15. The image forming apparatus as claimed in claim 13, wherein the detecting unit detects an image tone of a toner image of the plurality of patterns on the image bearing member.

16. The image forming apparatus as claimed in claim 13, wherein:

the transfer section includes a transfer member to which the toner image from the image bearing member is transferred, and the transfer member transfers the toner image thereon onto the recording medium, the detecting unit detecting an image tone of a toner image of the plurality of patterns on the transfer member.

17. The image forming apparatus as claimed in claim 1, further comprising:

a detecting unit to detect a latent image potential of the plurality of patterns.

18. The image forming apparatus as claimed in claim 17, wherein the ON start timing adjuster adjusts the ON start timing based on the latent image potential detected by the detecting unit.

19. The image forming apparatus as claimed in claim 13, further comprising:

an external input section to instruct forming of the plurality of patterns to the light beam scanning section.

20. The image forming apparatus as claimed in claim 19, wherein the external input section includes an operation panel.

21. The image forming apparatus as claimed in claim 13, wherein the ON start timing adjuster automatically adjusts the ON start timing at a predetermined period.

22. The image forming apparatus as claimed in claim 21, further comprising:

an external input section to variably set the predetermined period.

23. The image forming apparatus as claimed in claim 22, wherein the external input section includes an operation panel.

24. The image forming apparatus as claimed in claim 17, further comprising:

an external input section to instruct forming of the plurality of patterns to the light beam scanning section.

25. The image forming apparatus as claimed in claim 24, wherein the external input section includes an operation panel.

26. The image forming apparatus as claimed in claim 17, wherein the ON start timing adjuster automatically adjusts the ON start timing at a predetermined period.

27. The image forming apparatus as claimed in claim 26, further comprising:

an external input section to variably set the predetermined period.

28. The image forming apparatus as claimed in claim 27, wherein the external input section includes an operation panel.

29. The image forming apparatus claimed in claim 1, wherein:

the developing section successively develops toner images of different colors on the image bearing member, the transfer section successively transfers the toner images of the different colors onto the recording medium in an overlapping manner to form a color image, and the ON start timing adjuster adjusts the ON start timing with respect to plurality of patterns corresponding to the different colors.

30. The image forming apparatus claimed in claim 1, wherein:

the developing section successively develops toner images of different colors on the image bearing member, the transfer section includes a transfer member to which the toner images of the different colors from the image bearing member are successively transferred to form a color image, the transfer member transfers the color image thereon onto the recording medium, and the ON start timing adjuster adjusts the ON start timing with respect to plurality of patterns corresponding to the different colors.

* * * * *